US009251970B2

(12) United States Patent
Morimoto et al.

(10) Patent No.: US 9,251,970 B2
(45) Date of Patent: Feb. 2, 2016

(54) SWITCH

(71) Applicant: OMRON Corporation, Kyoto-shi, Kyoto (JP)

(72) Inventors: Masaru Morimoto, Shiga (JP); Takeshi Arihara, Kyoto (JP); Tomoyuki Washizu, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/384,297

(22) PCT Filed: Mar. 11, 2013

(86) PCT No.: PCT/JP2013/056667

§ 371 (c)(1),
(2) Date: Sep. 10, 2014

(87) PCT Pub. No.: WO2013/137201

PCT Pub. Date: Sep. 19, 2013

(65) Prior Publication Data

US 2015/0027866 A1 Jan. 29, 2015

(30) Foreign Application Priority Data

Mar. 15, 2012 (JP) ..... 2012-059181

(51) Int. Cl.
*H01H 1/36* (2006.01)
*H01H 3/50* (2006.01)
(Continued)

(52) U.S. Cl.
CPC . *H01H 1/36* (2013.01); *H01H 1/44* (2013.01); *H01H 3/50* (2013.01); *H01H 21/30* (2013.01);
(Continued)

(58) Field of Classification Search
CPC ..... H01H 1/18; H01H 1/20; H01H 1/26; H01H 2221/088; H01H 3/42; H01H 21/12; H01H 2221/036; H01H 3/40; H01H 1/40; H01H 1/44; H01H 21/24; H01H 2203/036; H01H 1/36; H01H 3/04; H01H 9/02; H01H 21/28; H01H 19/14; H01H 1/242; H01H 3/38; H01H 2235/01; H01H 21/14; H01H 21/36; H01H 2205/002; H01H 3/50; H01H 21/50; H01H 2229/014; H01H 2221/044; H01H 21/30
USPC ..... 200/252, 16 R–16 D, 520, 530–536, 553, 200/557–559, 561–563, 276.1, 61.82, 8 R, 200/17 R, 260, 11 R, 335
See application file for complete search history.

(56) References Cited

U.S. PATENT DOCUMENTS 4,268,728 A 5/1981 Rose
6,768,069 B1 * 7/2004 Su ..... H01H 1/242 200/276.1

(Continued)

FOREIGN PATENT DOCUMENTS

EP 1903590 A1 3/2008
JP 54-30274 2/1979

(Continued)

OTHER PUBLICATIONS

Office Action issued in Taiwanese Application No. 102109303, mailed on Nov. 25, 2014 (18 pages).

(Continued)

*Primary Examiner* — Edwin A. Leon
(74) *Attorney, Agent, or Firm* — Osha Liang LLP

(57) ABSTRACT

A switch has a base having a recess, and a plurality of fixed contacts mounted in an inner side face of the recess, an electrically conductive actuator disposed within the recess of the base, the electrically conductive actuator having a pair of movable contact portions and an elastically deformable elastic portion, the movable contact portions having movable contacts capable of being connected to respective fixed contacts, at least one engagement convex portion disposed on one of the base and the electrically conductive actuator, and at least one engagement concave portion disposed on the other of the base and the electrically conductive actuator and engageable with the at least one engagement convex portion. The elastic portion of the electrically conductive actuator is elastically deformed to break an engagement between the engagement convex and concave portions when the actuator moves between a first position and a second position.

20 Claims, 16 Drawing Sheets

(51) Int. Cl.
*H01H 21/50* (2006.01)
*H01H 1/44* (2006.01)
*H01H 21/30* (2006.01)

(52) U.S. Cl.
CPC ..... *H01H 21/50* (2013.01); *H01H 2205/002* (2013.01); *H01H 2221/044* (2013.01); *H01H 2229/014* (2013.01)

(56) References Cited

U.S. PATENT DOCUMENTS 6,917,008 B1 * 7/2005 Ni ..... H01H 21/282 200/16 C
7,223,931 B2 * 5/2007 Kiyono ..... H01H 1/36 200/276.1
2003/0094360 A1 * 5/2003 Nishimura ..... H01H 19/62 200/559

FOREIGN PATENT DOCUMENTS

| | | | |
|---|---|---|---|
| JP | 55-143723 | A | 11/1980 |
| JP | 56-31425 | | 3/1981 |
| JP | 2007-085428 | A | 4/2007 |
| JP | 2009-176470 | A | 8/2009 |
| JP | 2009-245801 | A | 10/2009 |
| JP | 2010-250944 | A | 11/2010 |
| TW | 2008-28375 | A | 7/2008 |

OTHER PUBLICATIONS

International Search Report for corresponding International Application No. PCT/JP2013/056667, mailed Apr. 9, 2013 (4 pages).

* cited by examiner

SWITCH

BACKGROUND

1. Technical Field

The present invention relates to a switch capable of providing a click feeling. In particular, the present invention relates to an ultra-compact and thin switch with minimum number of components, for use with electronic device such as mobile phone, smartphone, or digital camera.

2. Related Art

Patent Document 1 discloses a slide switch. The slide switch includes a slider capable of reciprocating between two positions and having a step mounted on its side surface, a housing accommodating the slider and having fixed contacts mounted on the bottom surface and spaced apart from each other in the moving direction of the slider, a movable contact member having arms extending obliquely downward and capable of making contacts with the fixed contacts mounted on the housing, a clicking metallic spring disposed between the inner side surface of the housing and the side surface of the slider and having a protrusion mounted on one side opposing the side surface of the slider, and a clicking resin spring disposed within the housing and capable of making contacts with the side surface of the slider.

According to the arrangement, when the slider is moved so that its step slides over the protrusion of the clicking metallic spring, it elastically deforms the clicking metallic and resin springs to cause a clicking feeling.

PATENT DOCUMENT

Patent Document 1: JP 2009-245801 A

SUMMARY OF THE INVENTION

The arms of the movable contacts in the switch, however, are extended obliquely downward from the bottom surface of the slider, increasing the thickness of a contact structure, which renders it difficult to reduce the thickness of the product. Additionally, the switch requires the housing, movable holder or slider, movable contact member, and spring members in order to provide the clicking feeling to the switch, which needs a considerably number of components.

One or more embodiments of the present invention reduces the thickness of the switch and its number of components while maintaining the click feeling.

A switch according to one or more embodiments of the present invention comprises a base having a recess and a plurality of fixed contacts mounted in an inner side face of the recess; an electrically conductive actuator accommodated within the recess of the base, the electrically conductive actuator having a pair of movable contact portions and elastically deformable elastic portion, the movable contact portions having movable contacts capable of being connected to respective fixed contacts; at least one engagement convex portion arranged in one of the base and the electrically conductive actuator; and at least one engagement concave portion arranged in the other of the base and the electrically conductive actuator and engageable with the at least one engagement convex portion; the elastic portion of the electrically conductive actuator being elastically deformed to break an engagement between the engagement convex and concave portions when the actuator moves between a first position and a second position, wherein in the first position the fixed and movable contacts are in contact with each other and the engagement convex and concave portions are engaged with each other.

According to one or more embodiments of the invention, when the actuator is moved between the first and second positions, a clicking feeling is obtained by the fact that the end of the engagement concave portion moves past the engagement convex portion. Also, the contact and clicking structures are arranged on the same plane, and the electrically conductive elastic member is fitted in the recess of the base, which reduces the thickness of the switch. This in turn reduces a space for accommodating the switch and facilitates the thinning of the electronic devices.

Further, the operating portion, the movable contacts, and the elastic portion are integrally formed to constitute the electrically conductive actuator, reducing the number of components. This reduces manufacturing costs and assembling processes.

According to one or more embodiments of the present invention, the upper face of the electrically conductive actuator is flush with the upper face of the base.

According to one or more embodiments of the invention, the switch is constitute to have a size depending on the thickness of the base.

According to one or more embodiments of the present invention, the actuator takes a third position which is adjacent the first position but away from the second position, wherein in the third position the fixed and movable contacts are in contact with each other and the engagement convex and concave portions are engaged with each other so that the engagement thereof is self-maintained.

According to one or more embodiments of the invention, the first position is defined at an intermediate position within a rotation range, thereby constituting a self-maintained switch which can reduce a maximum stroke from the first position and to which three kinds of modes can be assigned.

According to one or more embodiments of the present invention, the actuator takes a third position which is adjacent the first position but away from the second position, wherein in the third position the elastic portion is compressed, causing the electrically conductive actuator to move back into the first position.

According to one or more embodiments of the invention, the first position is defined at an intermediate position within a rotation range, thereby constituting a self-maintained on one side and a self-return switch on the other side which can reduce a maximum stroke from the first position and to which three kinds of modes can be assigned.

According to one or more embodiments of the present invention, the electrically conductive actuator is of a rotating type.

According to one or more embodiments of the invention, the actuator is moved by its rotational operation. In particular, this arrangement has an advantage that the actuator is arranged along a curved part of devices.

According to one or more embodiments of the present invention, the elastic portion is a circular frame having the at least one engagement recess.

According to one or more embodiments of the invention, the elastic portion is made of circular frame and the engagement concave portion is formed with the frame, reducing the number of components.

According to one or more embodiments of the present invention, the electrically conductive actuator is of a sliding type.

According to one or more embodiments of the invention, the actuator can be moved by its sliding operation. In particular, the actuator can be arranged along a liner part of devices.

According to one or more embodiments of the present invention, the electrically conductive actuator includes a substantially rectangular frame and that the at least one engagement recess is arranged in the elastic portion, and the elastic portion is arranged so as to connect two facing sides of the frame.

According to one or more embodiments of the invention, the elastic portion having the at least one engagement recess can be arranged within the frame to avoid the enlargement of the electrically conductive actuator.

According to one or more embodiments of the present invention, the electrically conductive actuator includes an operating portion, and the operating portion, the movable contacts, and the elastic portion are separately manufactured by electroforming and arranged on the same plane and then the operating portion, the movable contacts, and the elastic portion are integrated with each other.

According to one or more embodiments of the invention, the operating portion, the movable contacts, and the elastic portion are integrally formed to constitute the electrically conductive actuator, thereby reducing a parts count. The contact structure and the click structure are mounted on the same plane, and the electrically conductive actuator is accommodated in the recess of the base, thereby reducing the size of the switch. In particular, the electrically conductive actuator is manufactured by electroforming, achieving a thin switch.

According to one or more embodiments of the present invention, the electrically conductive actuator includes an operating portion, and the operating portion, the movable contacts, and the elastic portion are separately manufactured by electroforming and are arranged on the same plane. Also, the operating portion, the movable contacts, and the elastic portion are separated from each other.

According to one or more embodiments of the invention, a material is used for the operating portion, which is different from those for the movable contacts and the elastic portion. When the operating portion is long and narrow, separating the operating portion can increase the number of the electrically conductive actuator manufactured in a mold having a given area. The contact structure and the click structure are mounted on the same plane, and the electrically conductive actuator is housed in the recess of the base, thereby achieving smaller size switch. In particular, the electrically conductive actuator is manufactured by electroforming, thereby achieving a thinner switch.

DETAILED DESCRIPTION

Several embodiments of the present invention will be described with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Embodiment

As illustrated in FIGS. 1A to 4B, the switch according to the first embodiment includes a base 10, an actuator 30, and a cover 40.

Figure 3:
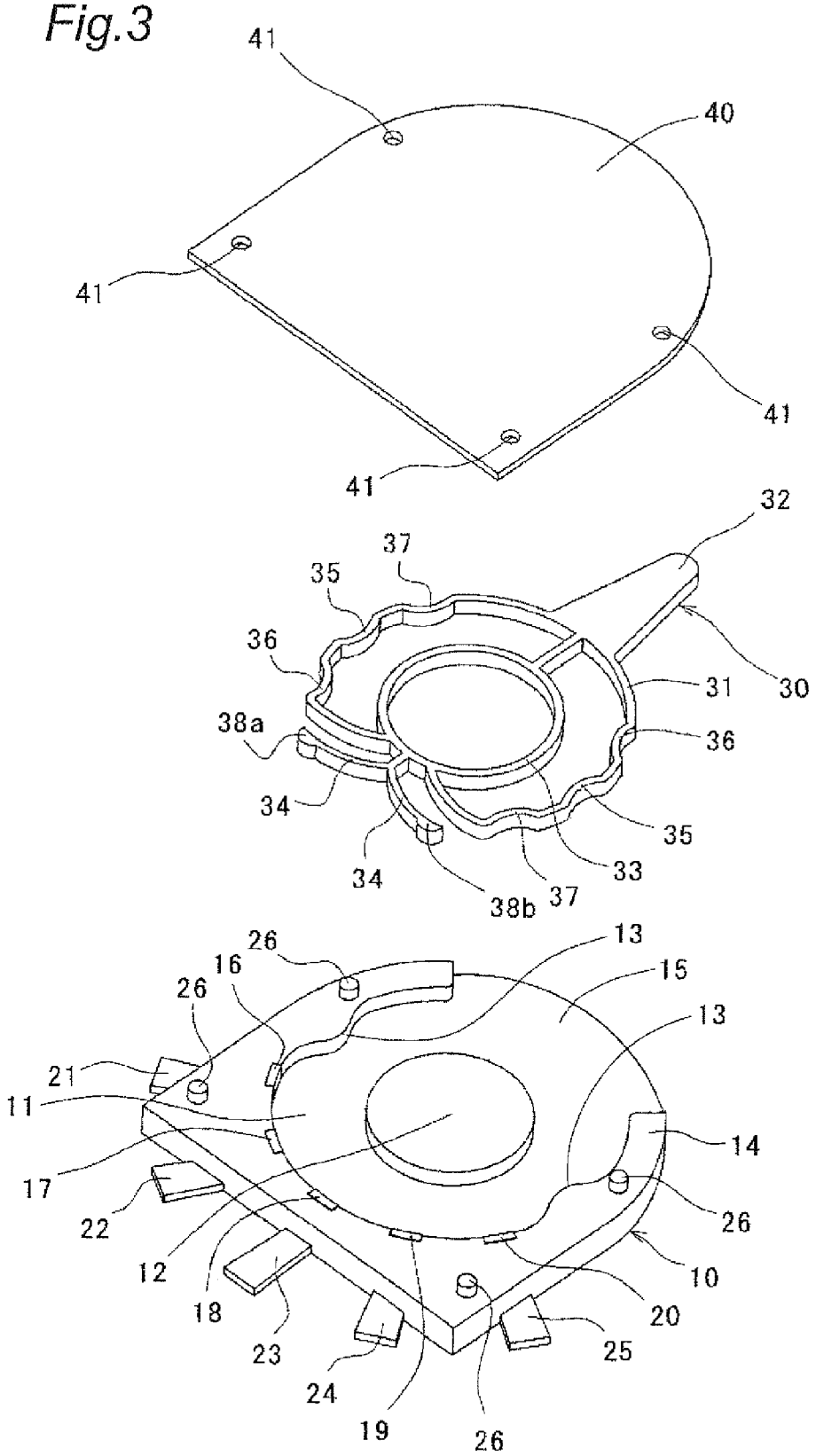
FIG. 3 is an exploded perspective view of the switch according to the first embodiment of the present invention.

As illustrated in FIG. 3, the base 10 has a fitting recess (hereinafter, referred to as "recess") 11 defined therein, in which the actuator 30 described below is fitted on its upper surface. The recess 11 has a shaft or boss 12 defined at its center for supporting an engaging portion 33 of actuator 30 described below. The opposing side surfaces defining in part the recess 11 have engagement concave portions 13 for engagement with associated engagement convex portions 35, 36, and 37 of the actuator 30 described below.

Figure 1A:
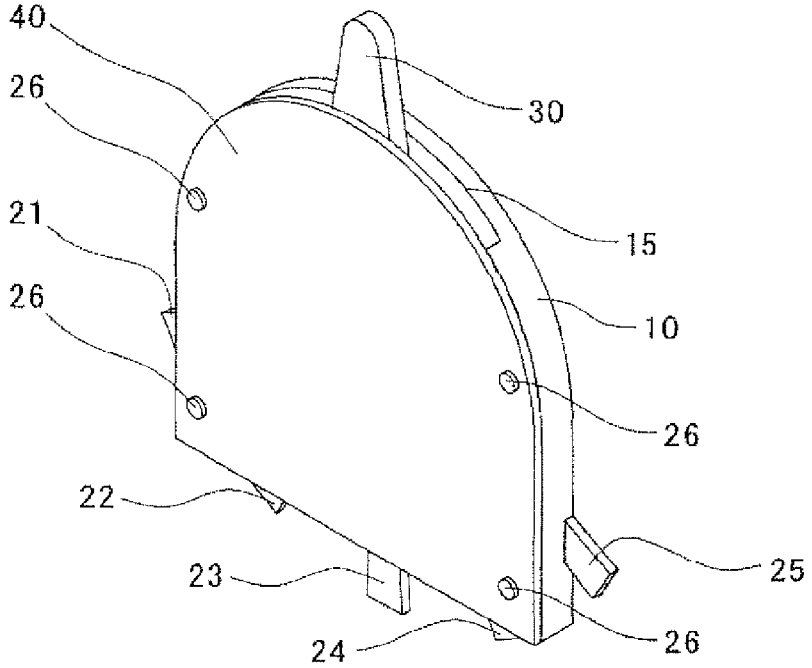
FIG. 1A is a perspective view a switch according to a first embodiment of the present invention.
Figure 1B:
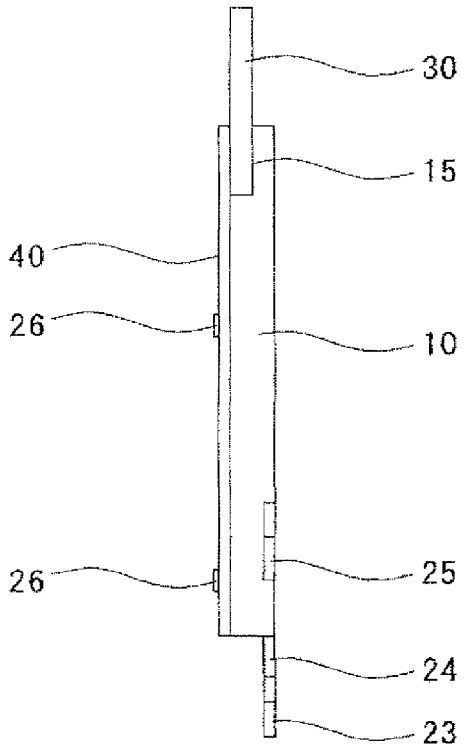
FIG. 1B is an elevational view of the switch according to the first embodiment of the present invention.
Figure 2:
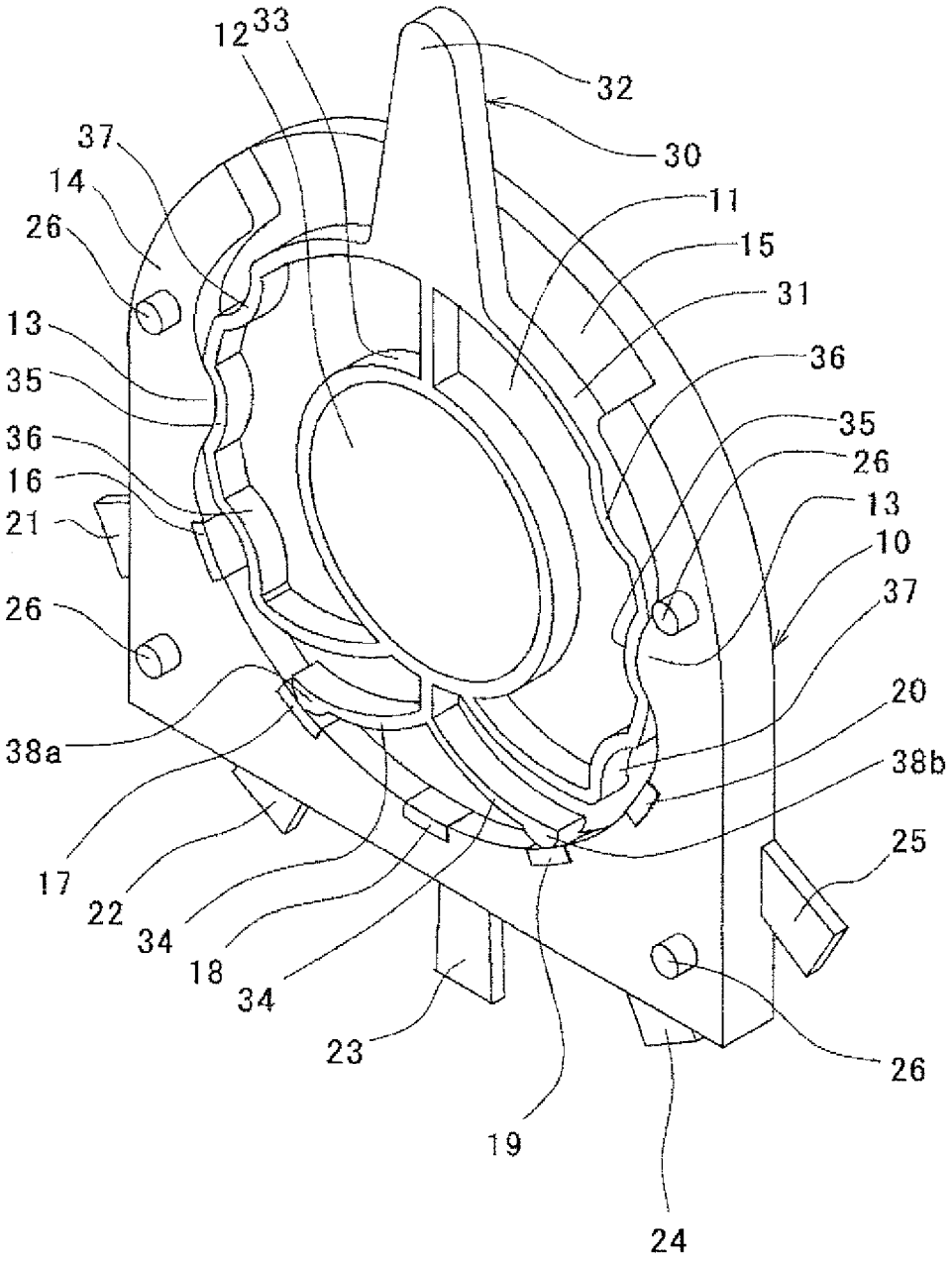
FIG. 2 is a perspective view illustrating a state in which a cover of the switch of the first embodiment is removed.

An outer peripheral wall 14 forming the recess 11 has an operational cutout or opening 15 defined by removing an upper part thereof indicated in FIGS. 1A and 1B. The opposite ends of the peripheral wall 14 are designed so that the arms 32 of the actuator 30 make contacts therewith when the switch takes the second and third positions. The inner side surfaces of the recess 11, away from the opening 15, supports a first fixed contact 16, a second fixed contact 17, a third fixed contact 18, a fourth fixed contact 19, and a fifth fixed contact 20 insert molded thereon at regular intervals. The third fixe contact 18 is located at the farthest position of the recess 11 from the opening. The peripheral wall 14 of the base 10 has snug-fitting projections 26 which are designed to snugly fit into the associated fitting holes 41 defined in the cover 40 described below.

The actuator 30 is an electrically conductive member which is manufactured by electroforming and has an elastic frame 31, the operating portion 32, the fitting portion 33, and a pair of movable contacting portions 34.

The actuator 30 has a thickness which causes the upper face thereof to be flush with that of the peripheral wall 14.

The elastic frame 31 is formed to have a substantially arc-shaped portion. The central angle of the arc is designed to be greater than that of semicircle. The radius of the elastic frame 31 is larger than a distance between the center of the recess 11 and the engagement convex portions 13 and is smaller than a distance between the center of the recess 11 and the portions of peripheral wall 14, other than the engagement convex portions 13. The non-arc-like end portions of the elastic frame 31 are bent inwardly toward the fitting portion 33 and connected thereto. The elastic frame 31 has a thickness which ensures that it deforms elastically when loaded from outside.

The elastic frame 31 has first, second, and third engagement recesses 35, 36, and 37, with the second and third engagement recesses 36 and 37 positioned symmetrically on opposite sides of the first engagement recess 35. The first, second, and third engagement recesses 35, 36, and 37 on one side and those on the other side are arranged point symmetrically with respect to the center of the fitting portion 33.

The operating portion 32 is provided at the center of the arc to extend radially outwardly therefrom. The distal end of the operating portion 32 is sized so that it protrudes from the base 10 when the fitting portion 33 is fitted around the boss 12 of the base 10.

The fitting portion 33 is a ring-like portion so that that it is fitted around the boss 12 of the base 10 and is positioned coaxially with and inside the elastic frame 31.

The movable contacting portions 34 are extended from respective portions of the elastic frame 31, farthest away from the operating portion 32, and shaped and sized so that they make contacts with the inner side surface of the recess 11. The distal ends of the movable contacting portion 34 supports paired contacts 38*a* and 38*b*. The contacts 38*a* and 38*b* are positioned so that they contact respective, secondary neighboring fixed contacts.

For example, when the actuator 30 takes a first position in which the first engagement recesses 35 engage with the engagement convex portions 13 of the base 10, the contacts 38*a*, 38*b* are in contact with the second and fourth fixed contact 17 and 19, respectively. When the actuator 30 takes a second position in which the second engagement recesses 36 engage with the engagement convex portions 13 of the base 10, the contacts 38*a* and 38*b* are in contact with the first and third fixed contact 16 and 18, respectively. When actuator 30 takes a third position in which the third engagement recesses 37 engage with the engagement convex portions 13 of the base 10, the contacts 38*a*, 38*b* are in contact with the third and fifth fixed contact 18 and 20, respectively.

The cover 40, which is a plate-like member sized and shaped to cover the base 10, has the fitting holes 41 at respective positions corresponding to the snug fitting projections 26 of the base 10.

When assembling, the fitting portion of the actuator 30 is rotatably fitted around the boss 12 of the base 12 with the operating portion 32 positioned at the center of the opening 15 of the base 10. Next, the cover 40 is placed on the base 10 with the fitting projections 26 fitted in the associated fitting holes 41 of the cover 40 and then the fitting projections 26 are fused to integrally connect the base 10 and the cover 40.

An operation of the switch so constructed will be described below. The switch of the first embodiment can be used for the mode setting of the video camera, for example.

Figure 4A:
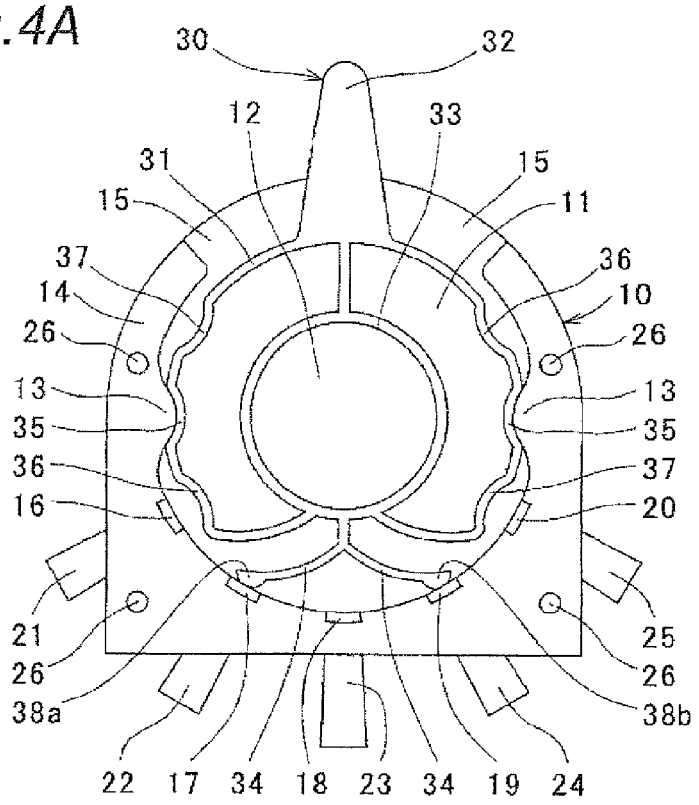
FIGS. 4A and 4B are diagrams illustrating respective positions of the switch.

In the first position illustrated in FIG. 4A, the first engagement recesses 35 of the actuator 30 engage with respective engagement convex portions 13 of the base 10. Also, in this position, the contacts 38*a* and 38*b* are in contact with the second and fourth fixed contacts 17 and 19, respectively, electrically connecting between the second and fourth fixed contacts 17 and 19.

Figure 4B:
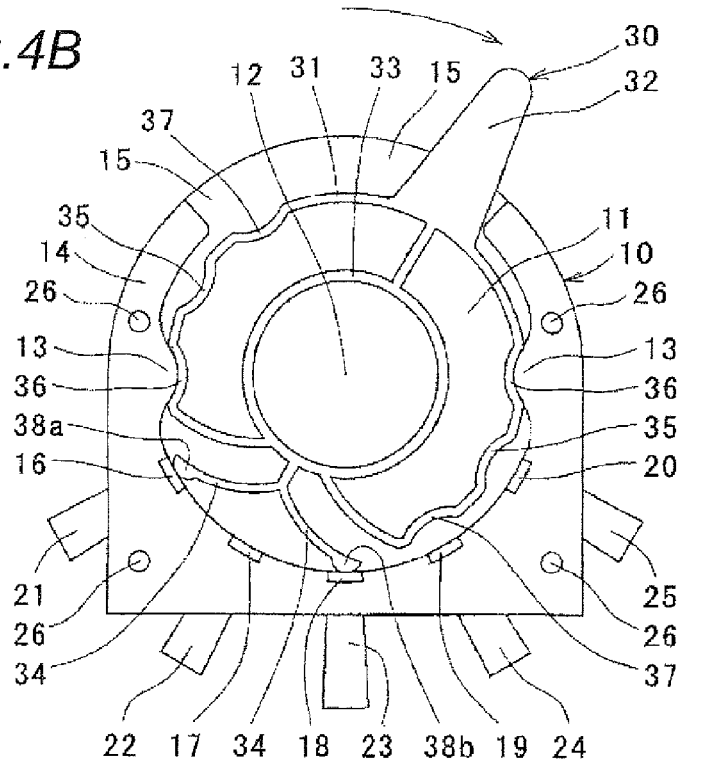

When the actuator 30 is rotated clockwise from the first position by using the operating portion 32, the elastic frame 31 elastically deforms as illustrated in FIG. 4B, causing the first engagement recesses 35, 35 to move away from the engagement convex portions 13 of the base 10 and, instead, the second engagement recesses 36 of the actuator 30 engage with the engagement convex portions 13 of the base 10, which results in that the actuator 30 takes the second position. In the second position, the contacts 38*a* and 38*b* are in contact with the first and third fixed contacts 16 and 18, respectively, electrically connecting between the first and third fixed contacts 16 and 18.

When, on the other hand, the actuator 30 is rotated counterclockwise from the first position, the third engagement recesses 37 of the actuator 30 engage with respective engagement convex portions 13 of the base 10, which results in that the actuator 30 takes the third position. In the third position, the contacts 38*a* and 38*b* are in contact with the third and fifth fixed contact 18 and 20, respectively, electrically connecting between the third and fifth fixed contacts 18 and 20.

According to one or more embodiments of the present invention, each time the actuator 30 moves between the first and second positions or between the first and third positions, a clicking feeling is provided when the tailing end of the engagement recessed portion passes by the engagement convex portion 13.

Also, the elastic frame 31, the operating portion 32, the fitting portion 33, and the movable contacting portions 34 are integrated into the actuator 30, reducing the number of components are reduced. This in turn reduces manufacturing costs and assembling processes.

Further, the contact and clicking structures are arranged on the same plane, and the thin elastic frame 31 is fitted in the planar fitting recess 11, which reduces the thickness of the switch. This in turn reduces a space for accommodating the switch and facilitates the thinning of the electronic devices.

Figure 5:
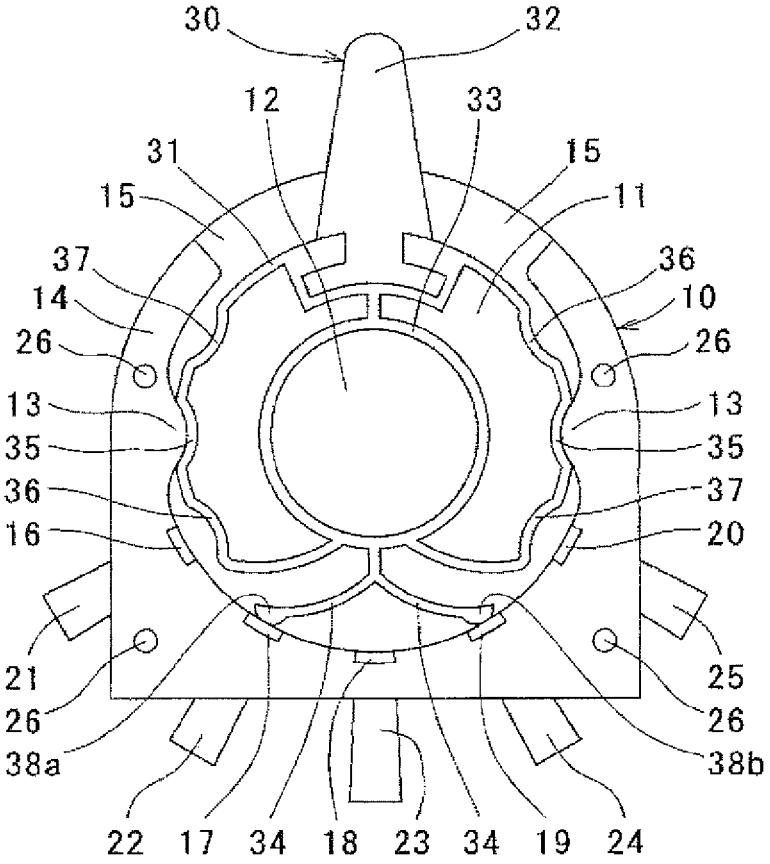
FIG. 5 is a diagram illustrating a modification of the switch according to the first embodiment.
Figure 6A:
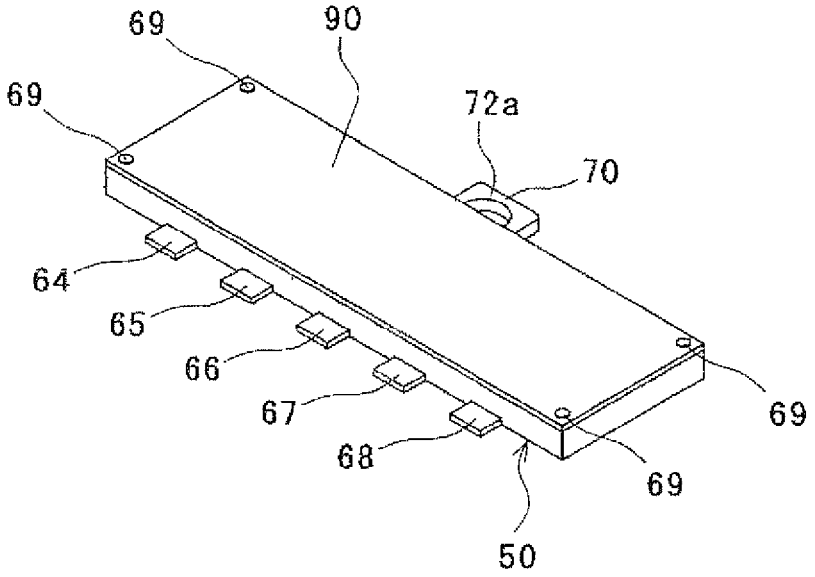
FIG. 6A a perspective view of a switch according to a second embodiment of the invention.
Figure 6B:
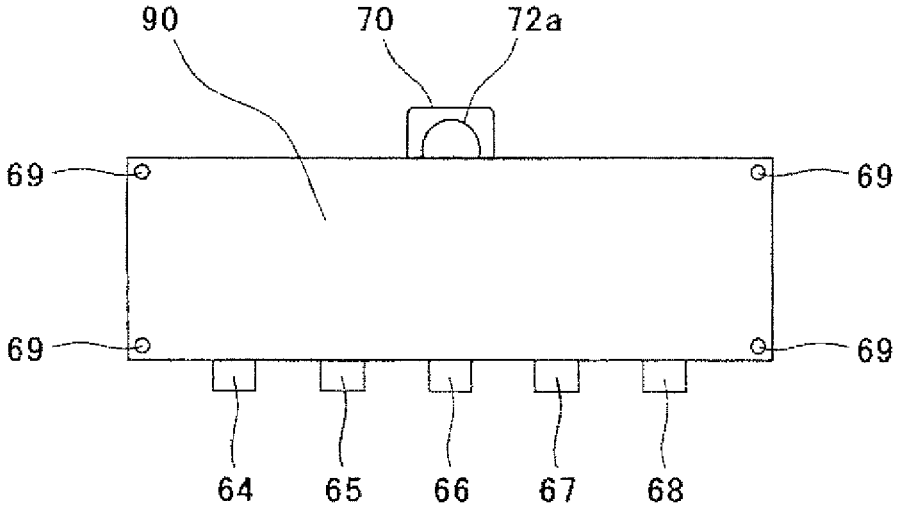
FIG. 6B an elevational view of the switch according to the second embodiment of the invention.
Figure 7:
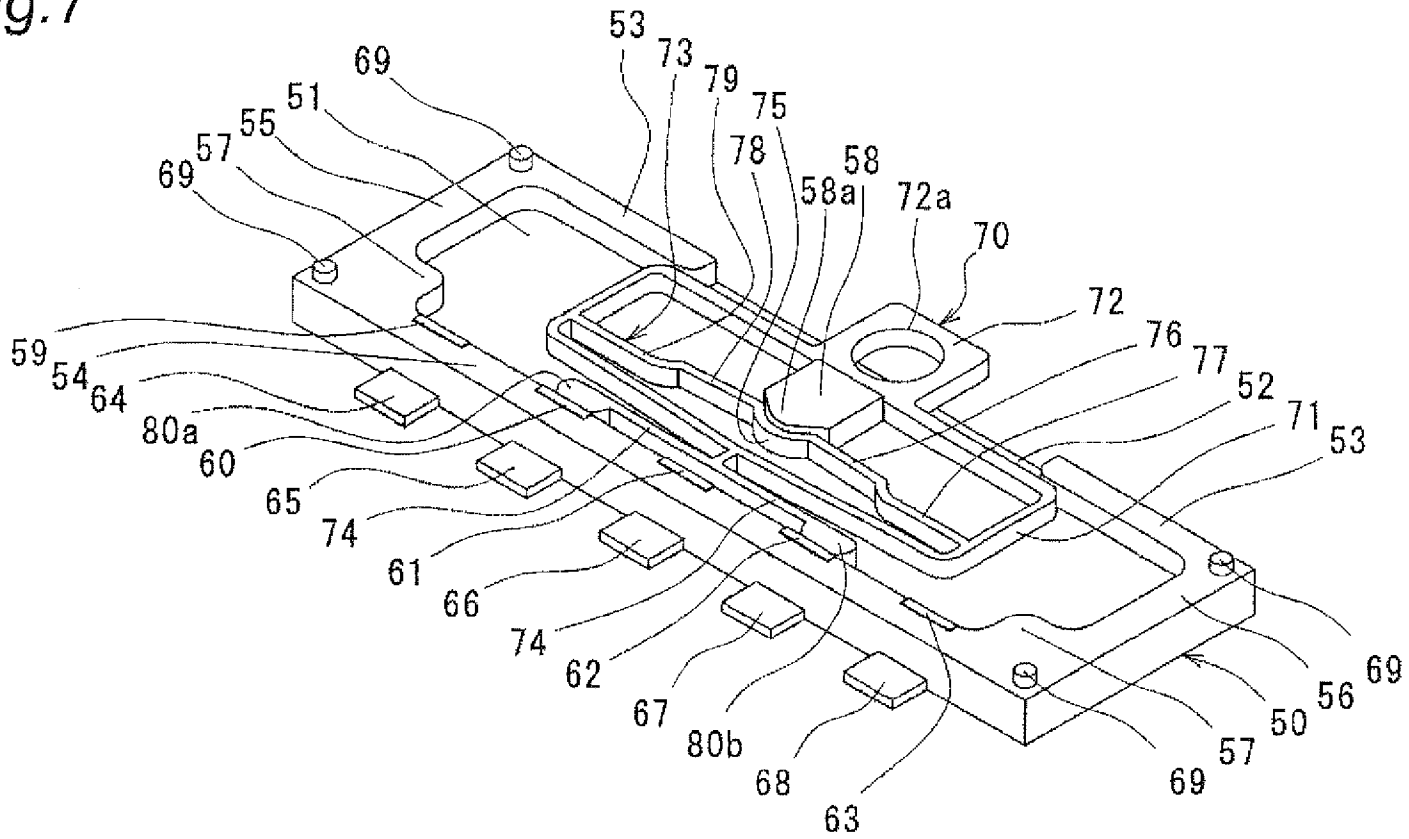
FIG. 7 is a perspective view illustrating a state in which a cover of the switch of the second embodiment is removed.

As illustrated in FIG. 5, the elastic frame 31 and the actuating portion 32 of the actuator 30 in the first embodiment may be separated into individual parts. Those parts may be connected by using engaging convex and concave portions provided in respective parts.

Second Embodiment

As illustrated in FIGS. 6A to 9B, the switch according to the second embodiment includes a base 50, an actuator 70, and a cover 90. The terminologies "up," "down," "left," and "right" below are used for convenience in describing the switch with reference to the drawings, which does not intend to limit the arrangement of the switch.

Figure 8:
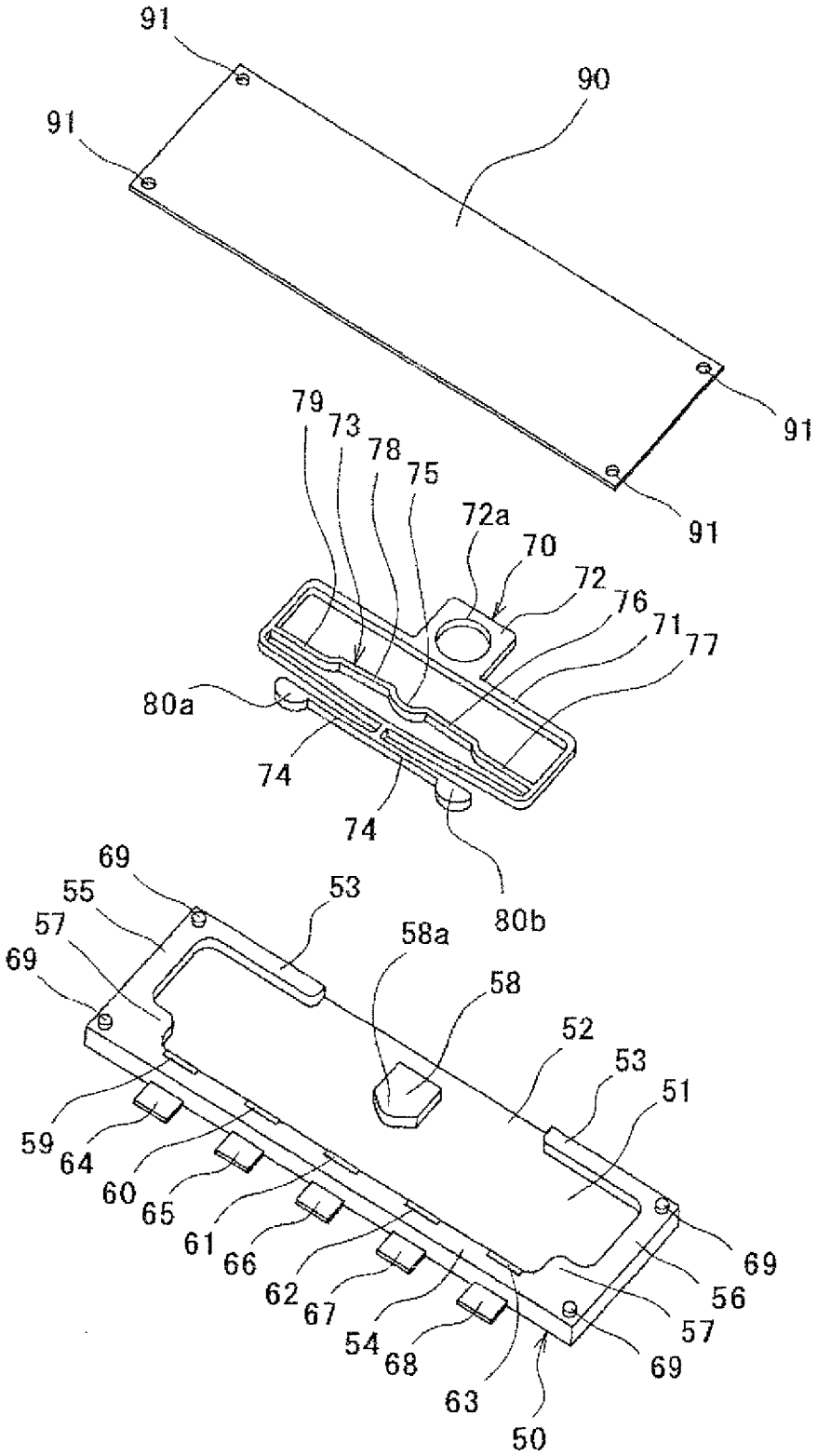
FIG. 8 is an exploded perspective view of the switch according to the second embodiment of the present invention.

As illustrated in FIG. 8, the base 50 has a substantially rectangular recess (hereinafter, referred to as "recess") 51 defined thereon for accommodating the actuator 70 described below on the upper surface thereof, forming a peripheral wall defining thereinside the recess 51. The peripheral wall, which has a cutout or opening 52 defined at the center of one of its longitudinally extending portions, includes upper peripheral portions 53 positioned on either side of the operational opening 52, a lower peripheral portion 54 opposing the upper peripheral portions 53, and left and right peripheral portions 55 and 56 connecting between the upper and lower peripheral portions. The upper peripheral portions 53 serve to guide the upper portions of a frame 71 of the actuator 70 described below. Lower guides 57 for guiding the lower portion of the frame 71 of the actuator 70 are formed at respective corners of the recess 51 of the left and right peripheral portions 55 and 56 and the lower peripheral portion 54. An internal distance between the upper peripheral portions 53 and the lower guides 57 is designed to be slightly larger than the transverse length of the frame 71 of the actuator 70.

A central guide 58 is formed on the upper surface of the recess 51. The central guide 58 is arranged at the longitudinal center of the recess 51, adjacent the operational opening 52 but off the transverse center of the base. The central guide 58 is substantially pentagon-shaped when viewed from above, in which a portion thereof opposing the lower peripheral portion 54 is convex-arched toward the lower peripheral portion 54 to form an engagement convex portion 58*a*. A transverse internal distance between the upper edge of the central guide 58 and the lower edge of the upper peripheral portions 53 is slightly larger than the thickness of the longitudinal portion of the frame 71 adjacent the operating portion 72.

The longitudinal peripheral portion 54 supports, at and long its inner longitudinal edges, first to fifth fixed contacts 59-63 insert molded therein at regular intervals. In particular, the third fixed contact 61 is positioned immediately below the central guide 58. The fixed contacts 59 to 63 have respective connecting portions 64 to 68 which protrude from the outer longitudinal side surface of the lower peripheral portion 54. The peripheral portions 53-56 of the base 50 supports snug fitting projections 69 formed therewith which will be snug-fitted in the associated fitting holes 91 of the cover 90 described below.

The actuator 70, which is an electrically conducting member manufactured by electroforming, includes the frame 71, the operating portion 72, an elastic engagement portion 73, and movable contacting portions 74. The actuator 70 is accommodated within the recess 51 of the base 50 so that the upper face thereof is flush with that of the base 50.

The frame 71 is substantially rectangular-shaped and its longitudinal size is larger than the width of the operational opening 52 of the base 50 in that direction. The left and right, transverse portion of the frame 71 is slightly shorter than the internal distance between the upper peripheral portions 53 and the lower guides 57 of the base 50. The longitudinal portion of the frame 71 adjacent the movable contacting portions 74 is convexly curved outward.

The operating portion 72 extends outward from the central portion of the longitudinal portion of the frame 71. The operating portion 72 has an aperture 72*a* defined therethrough which serves as an engagement for holding a cover provided thereon (not illustrated).

The elastic engagement portion 73, which extends between the opposing left and right transverse portions of the frame 71, has a first engagement recessed portion 75 formed at the center of the elastic engagement portion 73 for engagement with the engagement convex portion 58*a* of the central guide 58, a second engagement recessed portion 77 formed on the right of the first engagement recessed portion 75, and a third engagement recessed portion 79 formed on the left thereof. The elastic engagement portion 73 also has narrowing portions 76 and 78 formed between the engagement recessed portions 75 and 77, and 75 and 79. The narrowing portions 76, 78 incline downwardly toward the left and right transverse portions. The internal distance between the narrowing portions 76 and 78 and the longitudinal portion of the frame 71 adjacent the operating portion 72 is smaller than the maximum distance between the first engagement recessed portion 75 and the longitudinal portion of the frame 71 adjacent the operating portion 72. Either the second or third engagement recessed portion 77 or 79 can engage the engagement convex portion 58*a* of the central guide 58 when the operating portion 72 of the actuator 70 is in contact with the corresponding inner distal end of the upper peripheral portion 53.

The movable contacting portions 74 extend symmetrically from the center of the longitudinal portion of the frame 71 to terminate at respective contacts 80*a* and 80*b*. The contacts 80*a* and 80*b* are positioned so that they will contact secondary neighboring fixed contacts. The movable contacting portions 74 are positioned to force the inner side surface of the recess 51 of the base 50.

For example, in the first position, the first engagement recessed portion 75 of the actuator 70 engages with the engagement convex portion 58*a* of the base 50, and the contacts 80*a* and 80*b* are in contact with the second and fourth fixed contacts 60 and 62, respectively. In the second position, the second engagement recessed portion 77 of the actuator 70 engages with the engagement convex portion 58*a* of the base 50, the contacts 80*a*, 80*b* are in contact with the first and third fixed contacts 59 and 61, respectively. In the third position, the third engagement recessed portion 79 of the actuator 70 engages with the engagement convex portion 58*a* of the base 50, and the contacts 80*a*, 80*b* are in contact with the third and fifth fixed contacts 61 and 63, respectively.

The cover 90, which is a plate-like member sized and shaped to cover the base 50, has the fitting holes 91 at respective positions corresponding to the snug fitting projections 69 of the base 50.

The actuator 70 is accommodated within the recess 51 so that, for example, the first engagement recessed portion 75 engages the engagement convex portion 58*a* of the central guide 58 of the base 50 and the operating portion 72 of the actuator 70 positions at the center of the operational opening 52 of the base 50. The snug fitting projections 69 of the base 50 are fitted in the associated fitting holes 91 of the cover 90. Then, the snug fitting projections 69 are fused to integrally connect the base 50 and the cover 90.

Next, an operation of the switch so constructed will be described below. The switch of the second embodiment can be used for the mode setting of the video camera, for example. It can also be used for the mode setting among still picture photographing mode, moving picture photographing mode, and reproduction mode.

Figure 9A:
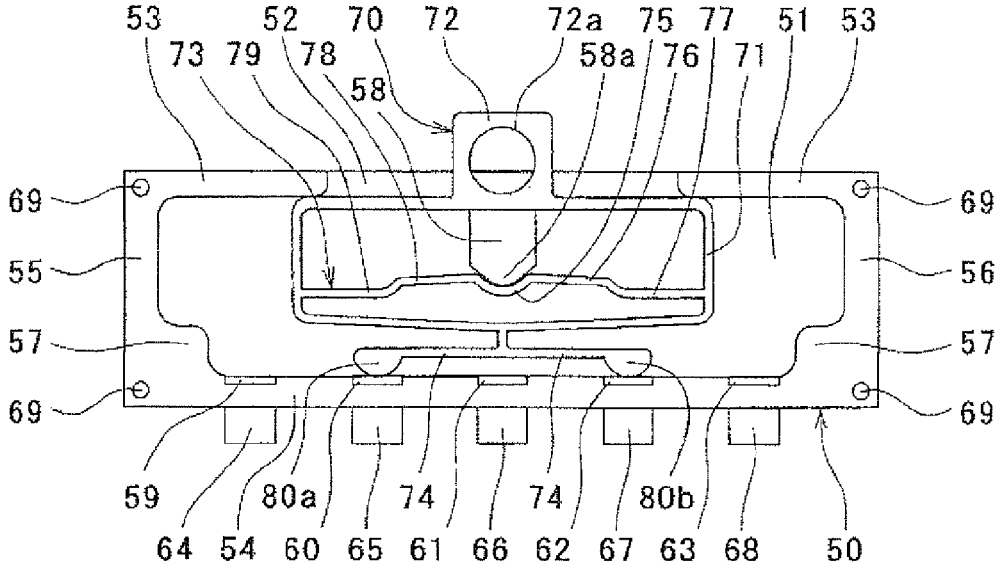
FIGS. 9A and 9B are diagrams illustrating respective positions of the switch.

First, in the first position illustrated in FIG. 9A, the first engagement recessed portion 75 of the actuator 70 engages the engagement convex portion 58*a* of the central guide 58 of the base 50. Also, the contacts 80*a* and 80*b* are in contact with the second and fourth fixed contacts 60 and 62, respectively, electrically connecting between the second fourth fixed contacts 60 and 62.

Figure 9B:
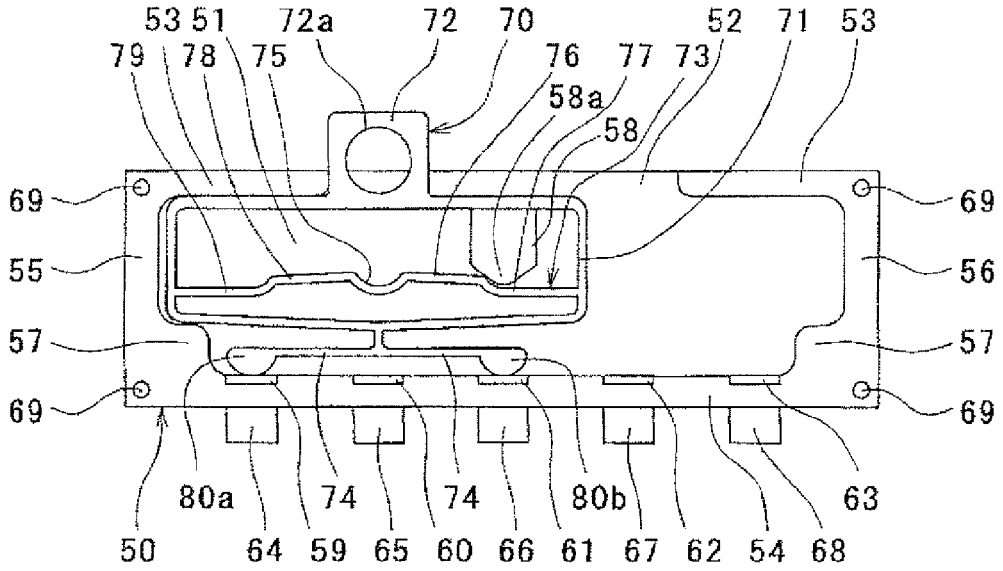

When the actuator 70 is moved leftward from the first position through the operating portion 72, as illustrated in FIG. 9B, the elastic engagement portion 73 elastically deforms to allow the first engagement recessed portion 75, breaking the engagement with the engagement convex portion 58*a* of the central guide 58 of the base 50. Then, the second engagement recessed portion 77 of the actuator 70 reaches the second position in which it engages with the engagement convex portion 58*a* of the central guide 58 of the base 50. In the second position, the contacts 80*a* and 80*b* are in contact with the first and third fixed contact 59 and 61, respectively, electrically connecting between the first fixed and third contacts 59 and 61.

When the actuator 70 is moved rightward from the first position, the third engagement recessed portion 79 of the actuator 70 engages the engagement convex portion 58*a* of the central guide 58 of the base 50 in the third position. In this position, the contacts 80*a* and 80*b* are in contact with the third and fifth fixed contacts 61 and 63, respectively, electrically connecting the third and fifth fixed contacts 61 and 63.

According to one or more embodiments of the invention, each time the actuator 70 moves between the first and second positions or between the first and third position, a clicking feeling is provided when the tailing end of the engagement recessed portion passes by the engagement convex portion 58*a*.

Also, the frame 71, the operating portion 72, the fitting portion 73, and the movable contacting portions 74 are integrated into the actuator 70, reducing the number of components are reduced. Further, the contact and clicking structures are arranged on the same plane, and the thin elastic frame 71 is fitted in the planar fitting recess 51, which reduces the thickness of the switch. This in turn reduces a space for accommodating the switch and facilitates the thinning of the electronic devices.

Third Embodiment

Figure 10:
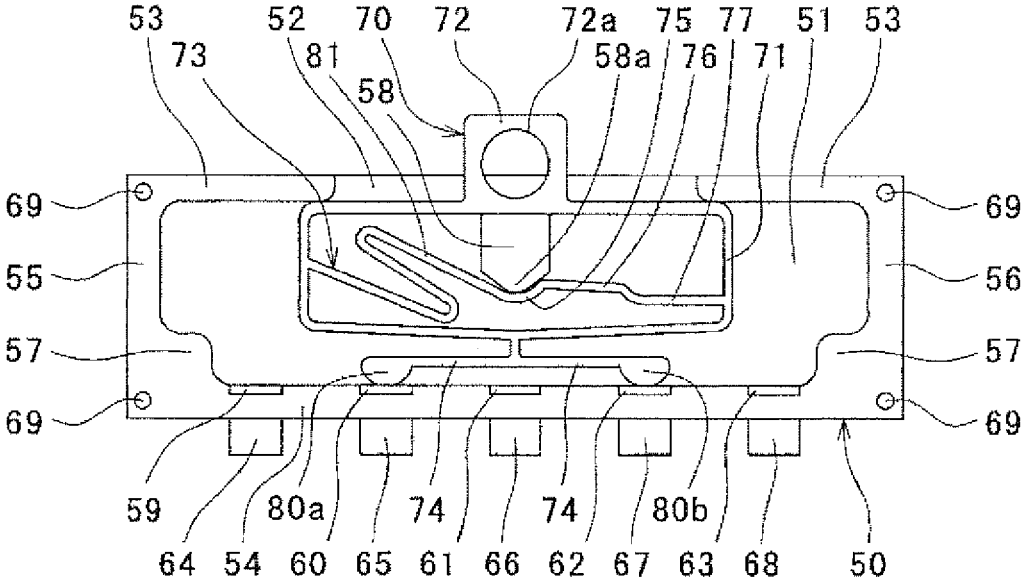
FIG. 10 is a diagram illustrating a switch according to a third embodiment of the present invention.

FIG. 10 illustrates a switch of the third embodiment of the present invention. This switch is substantially similar to the second embodiment, but it is different from that in that the actuator in the second position is maintained in its position while the actuator in the third position is automatically returned to the first position. In the third embodiment, like reference numerals designate like components in the second embodiment to the descriptions thereto will be omitted.

As illustrated in FIG. 10, the elastic engagement portion 73 of the switch has the narrowing portion 76, the second engagement recessed portion 77 on one side of the first engagement recessed portion 75, and an elastic inclined portion (elastic portion) 81 on the other side of the first engagement recessed portion 75. The elastic inclined portion 81 is formed like "S" inclined toward right. One end of the "S" shaped, elastic inclined portion is connected to the first engagement recessed portion 75, and the other end is connected to the adjacent transverse side portion of the frame 71. In other words, the part of the elastic inclined portion 81 adjacent the first engagement recessed portion 75 extends obliquely upward from the first engagement recessed portion 75.

When the actuator 70 is moved leftward from the first position, this switch works in the same manner as in the second embodiment.

When, on the other hand, the actuator 70 is moved rightward from the first position, the elastic inclined portion 81 is pressed and compressed by the engagement convex portion 58*a* of the central guide 58 of the base 50. When the actuator 70 is moved to the third position, the contacts 80*a* and 80*b* come into contact with the third and sixth fixed contacts 61 and 63, respectively, electrically connecting the third and sixth fixed contacts 61 and 63.

When the load applied to the actuator 70 is removed at the third position, the elastic inclined portion 81 elastically is forced leftward and, as a result, the actuator 70 is returned to the first position.

According to the third embodiment, the actuator is maintained in the second position on one side of the first position while it is automatically returned to the first position when the load applied to the operating portion 72 of the actuator 70 is removed at the third position on the other side. The switch can be used in a mobile phone, smartphone, or portable music players with one maintaining side served as power-on switch and the opposite, automatically returning side served as operation lock switch.

Fourth Embodiment

Figure 11A:
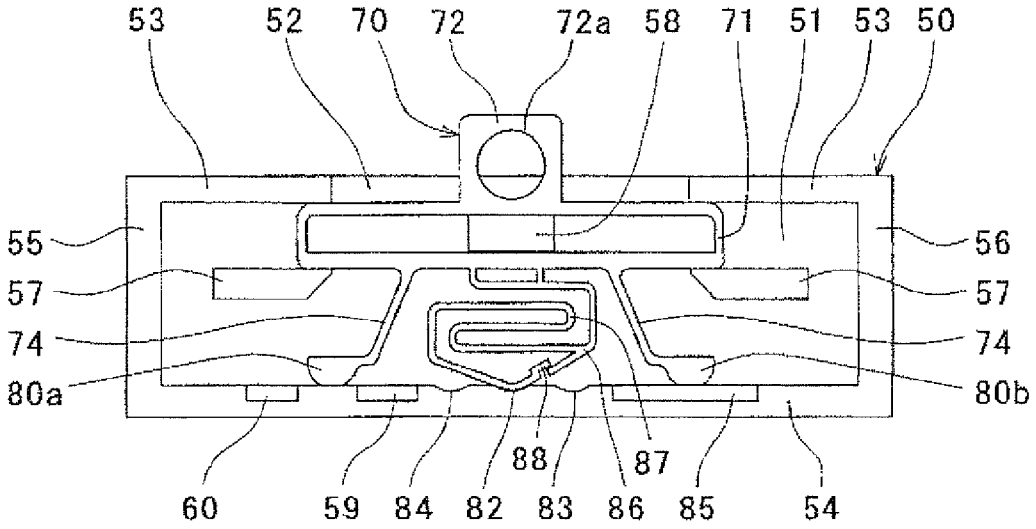
FIGS. 11A and 11B are diagrams illustrating a switch according to a fourth embodiment of the present invention.
Figure 11B:
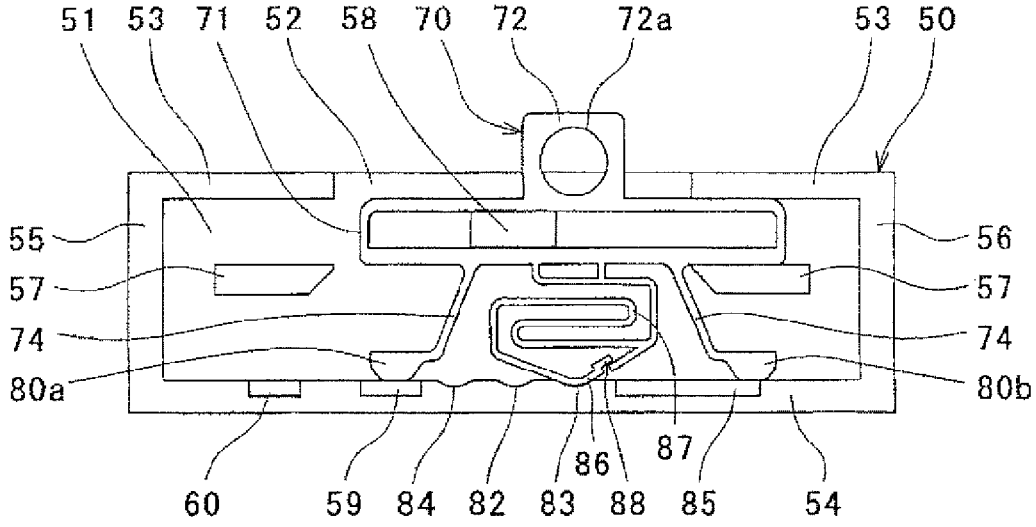

FIGS. 11A and 11B illustrate the switch of a fourth embodiment of the present invention. In the fourth embodiment, like reference numerals designate like components in the second embodiment to the descriptions thereto will be omitted.

The base 50 has the lower guides 57, 57 for guiding the lower portion of the frame 71 of the actuator 70 provided on the left and right sides of the recess 51. The central guide 58 arranged between the lower guides 57 of the base 50 has a substantially rectangle-shape when viewed from above. The lower peripheral portion 54 has a second engagement recess 83, a third engagement recess 84, and a first engagement recess 82 formed immediately below the central guide 58 between the second and third engagement recesses 83 and 84. The first engagement recess 82, the second engagement recess 83, and the third engagement recess 84 are positioned at regular intervals. A common fixed contact 85 is insert molded in the inner side face of the lower peripheral portion 54, on the right side of the second engagement recess 83. The common fixed contact 85 is extended so that the contact 80*b* of the actuator 70 keeps in contact therewith whenever an engagement convex portion (elastic portion) 86 of the actuator 70 positions between the engagement recesses 82 to 84. The first fixed contact 59 and the second fixed contact 60 are insert molded in the inner side surface of the lower peripheral portion 54 positioned on the left side of the third engagement recess 84.

The actuator 70 has an engagement convex portion 86 which extends outward from the center of the longitudinal portion between the movable contacting portions 74, in place of the elastic engagement portion 73 of the second embodiment. The engagement convex portion 86 has a substantially pentagonal, unicursally extended configuration when viewed from above, formed with a pointed lower portion which is capable of engaging the engagement recesses 82 to 84 of the base 50. In order to allow the actuator 70 to take any one of three positions—the first position in which the engagement convex portion 86 engages the first engagement recess 82, the second position in which the engagement convex portion 86 engages the second engagement recess 83, and the third position at which the engagement convex portion 86 engages the third engagement recess 84, the engagement convex portion 86 has a tortuous portion 87 and an overlapping portion 88. The tortuous portion 87, which is formed in the middle of the unicursally extended configuration, supports the engagement convex portion 86 so that it can elastically deform in the vertical direction. The overlapped portion 88 defines in part the pointed part of the substantially pentagonal configuration. The overlapped portion 88 is formed so that the tip of the unicursally extended configuration engages a part of the engagement convex portion 86.

The actuator 70 is accommodated within the recess 51 with the frame 71 fitted on the central guide 58 of the base 50 and the operating portion 72 of the actuator 70 arranged at the center of the operational opening 52 of the base 50. The snug fitting projections 69 of the base 50 are snug fitted on the snug fitting holes 91 of the cover 90. Then, the snug fitting projections 69 are fused to integrate the base 50 and the cover 90.

In the first position illustrated in FIG. 11A, the engagement convex portion 86 of the actuator 70 engages the first engagement recess 82 of the base 50. In the first position, the contact 80*a* is positioned on the lower peripheral portion 54 between the first and second fixed contacts 59 and 60, while the other contact 80*b* is in contact with the common fixed contact 85. In this instance, the contact 80*a* is out of contact with any of the fixed contacts 59 and 60 which are electrically disconnected from the common fixed contact 85.

As illustrated in FIG. 11B, when the actuator 70 is moved rightward from the first position through the operating portion 72, the engagement convex portion 86 of the operating portion 72 elastically deforms to allow the engagement convex portion 86 to move away from the first engagement recess 82 of the base 50. The engagement convex portion 86 of the actuator 70 engages the second engagement recess 83 of the base 50, reaching the second position. In the second position, the contacts 80*a* and 80*b* are in contact with the first fixed contact 59 and the common fixed contact 85, electrically connecting between the first fixed contact 59 and the common fixed contact 85.

When the actuator 70 is moved leftward from the first position, the engagement convex portion 86 of the actuator 70 engages the third engagement recess 84 of the base 50 in the third position. In this position, the contacts 80*a* and 80*b* are in contact with the second fixed contact 60 and the common fixed contact 85, respectively, electrically connecting between the second fixed contact 60 and the common fixed contact 85.

Fifth Embodiment

Figure 12A:
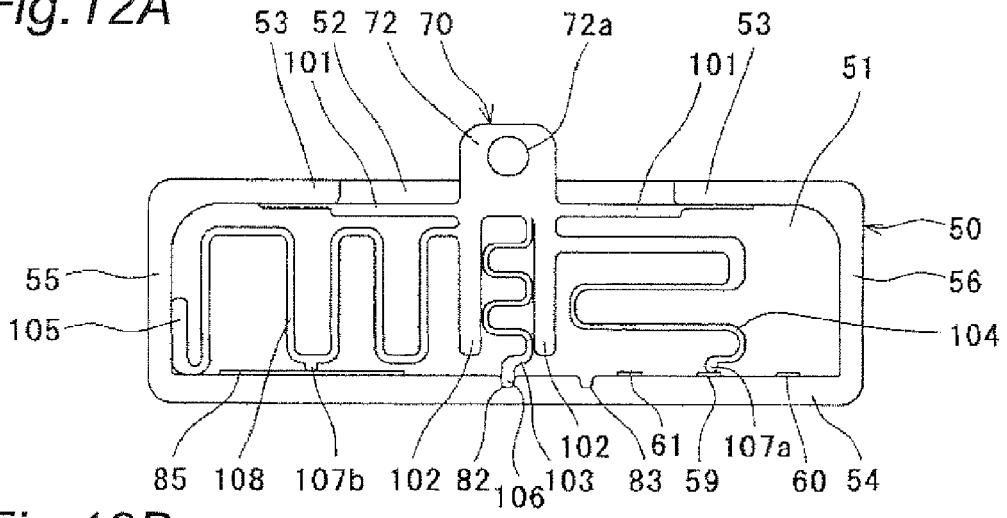
FIGS. 12A to 12C are diagrams illustrating a switch according to a fifth embodiment of the present invention.
Figure 12B:
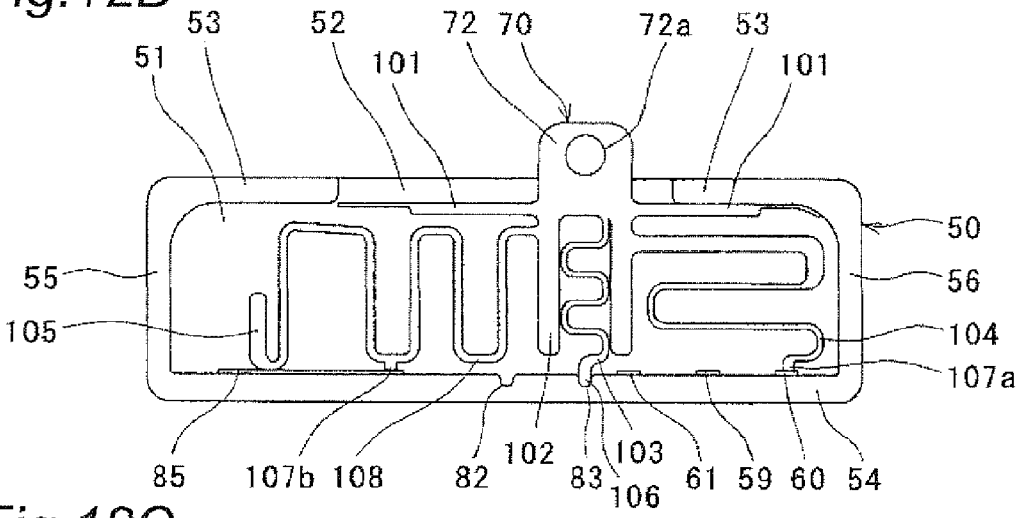
Figure 12C:
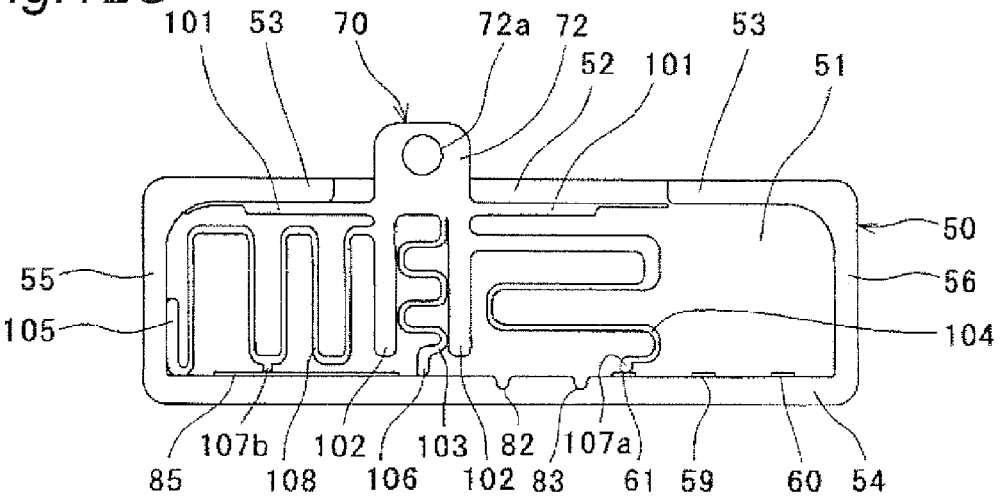
Figure 13A:
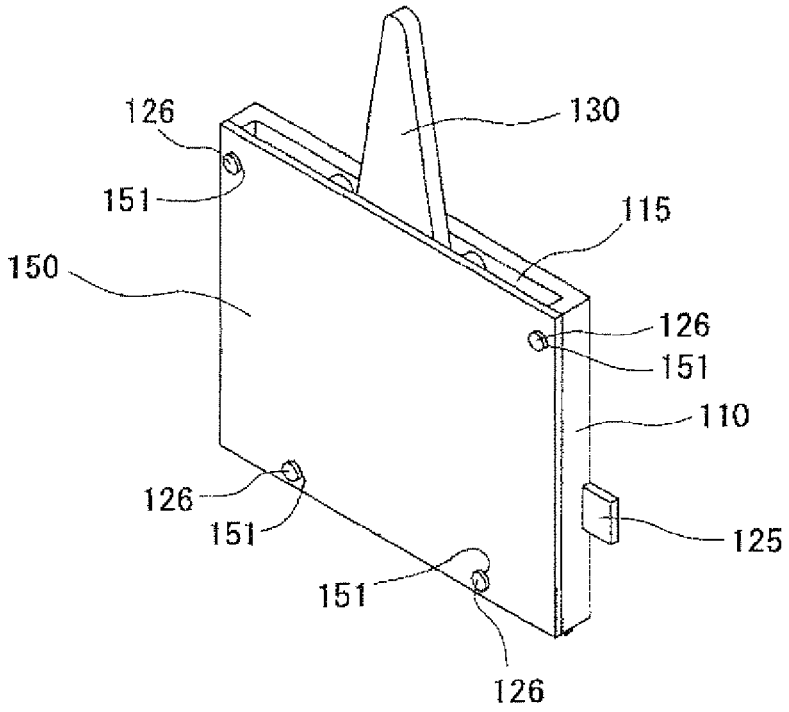
FIGS. 13A and 13B are diagrams illustrating a switch according to a sixth embodiment of the present invention.
Figure 13B:
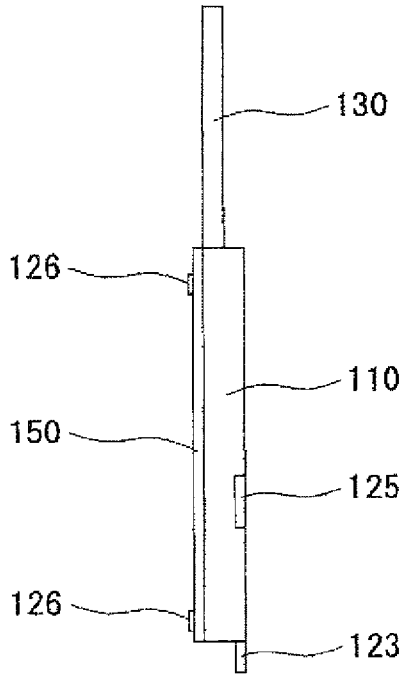

As illustrated in FIGS. 12A to 12C, the switch according to the fifth embodiment has the base 50, the actuator 70, and the cover 90.

In the base 50, the opposite corners of the recess 51 at which the upper peripheral portions 53 and the left and right peripheral portions 55 and 56 intersect are rounded. This results in that the tip of arms 101 of the actuator 70 to be elastically deformable along the inner side face of the recess 51. The upper peripheral portions 53 guide the upper part of the arms 101 of the actuator 70.

Also, in the base 50, the first fixed contact 59 is insert-molded on the right-hand area of the inner side face of the lower peripheral portion 54. The first fixed contact 59 is a dummy contact which makes no contact with the fixed contact. The second fixed contact 60 is insert-molded on the inner side face of the lower peripheral portion 54 on the right side of the first fixed contact 59. The third fixed contact 61 is insert-molded on the inner side face of the lower peripheral portion 54 on the left side of the first fixed contact 59. The common fixed contact 85 is formed on the inner side face of the lower peripheral portion 54 so that a contact 107*b* of a second movable contacting portion 105 described below makes contact therewith in any of the first to third positions. The first engagement recess 82 is formed at the center of the inner side surface of the lower peripheral portion 54. The second engagement recess 83 is formed on the inner side surface of the lower peripheral portion 54 between the first engagement recess 82 and the third fixed contact 61.

The actuator 70, which is an electrically conducting member manufactured by electroforming, includes the operating portion 72, a pair of arms 101, 101, a pair of legs 102, 102, an elastic portion 103, a first movable contacting portion 104, and a second movable contacting portion 105.

The pair of arms 101 extend leftward and rightward from the proximal end of the operating portion 72, respectively. The distal end of the arm 101 is thinner than its proximal end and has an elastically deformable thickness. The pair of legs 102 are extended downward from the proximal end of the operating portion 72 as they are spaced apart from each other. The elastic portion 103 extends downward between the pair of legs 102. The elastic portion 103 is formed in the form of bellows which is extendable and compressible in the vertical direction with its distal end pointed downward. The distal end of the elastic portion 103 forms an engagement convex portion 106 which engages with the engagement recesses 82 and 83. The distal end of the elastic portion 103 is positioned below the inner side surface of the lower peripheral portion 54 when it is not loaded.

The first movable contacting portion 104 extends rightward from the upper part of the right leg 102 and then downward, forming a bellows which is extendable and compressible in the vertical direction. The distal end of the first movable contacting portion 104 forms a contact 107*a*.

The second movable contacting portion 105 extends leftward from the upper part of the left leg 102, forming a bellows (elastic portion) 108 which is elastically deformable in the horizontal direction. The distal end of the second movable contacting portion 105, which has a thickness incapable of elastically deforming, extends in the vertical direction. The bellows 108 of the second movable contacting portion 105 forms a contact 107*b* which is in contact with the common fixed contact 85 in any of the first to third positions.

First, in the first position illustrated in FIG. 12A, the engagement convex portion 106 of the elastic portion 103 of the actuator 70 engages the first engagement recess 82 of the base 50. In this position, the contact 107*a* of the first movable contacting portion 104 is in contact with the first fixed contact 59, while the contact 107*b* of the second movable contacting portion 105 is in contact with the common fixed contact 85. Because the first fixed contact 59 is a dummy contact, no electrical connection occurs in the switch.

As illustrated in FIG. 12B, when the actuator 70 is moved rightward from the first position through the operating portion 72, the elastic portion 103 elastically deforms, and the engagement convex portion 106 moves out of the first engagement recess 82 of the base 50 and engages the second engagement recess 83 of the base 50 when it reaches the second position. In the second position, the contact 107*a* of the first movable contacting portion 104 is in contact with the second fixed contact 60, while the contact 107*b* of the second movable contacting portion 105 is in contact with the common fixed contact 85, electrically connecting between the second fixed contact 60 and the common fixed contact 85.

When the actuator 70 is moved leftward from the first position through the operating portion 72, the elastic portion 103 elastically deforms and the engagement convex portion 106 moves out of the first engagement recess 82 of the base 50 to reach the third position adjacent the common fixed contact 85 (FIG. 12(C)). The first movable contacting portion 104 moves from the first fixed contact 59 to the third fixed contact 61. In the third position, the second movable contacting portion 105 is forced toward the left peripheral portion 55 of the base 50. In the third position, the contact 107*a* of the first movable contacting portion 104 is in contact with the third fixed contact 61, while the contact 107*b* of the second movable contacting portion 105 is in contact with the common fixed contact 85, electrically connecting between the third fixed contact 61 and the common fixed contact 85.

When the load on the actuator 70 is removed at the third position, the actuator 70 is forced back rightward by the elastic force from the compressed bellows 108 of the second movable contacting portion 105. The engagement convex portion 106 of the elastic portion 103 of the actuator 70 engages the first engagement recess 82 of the base 50 in the first position.

According to the fifth embodiment, a switch is maintained in the second position on one side of the first position and automatically returned to the first position from the third position on the other side thereof.

Sixth Embodiment

As illustrated in FIGS. 13A to 15, the switch according to the sixth embodiment includes a base 110, an actuator 130, an electrically conductive elastic member 140, and a cover 150.

Figure 14:
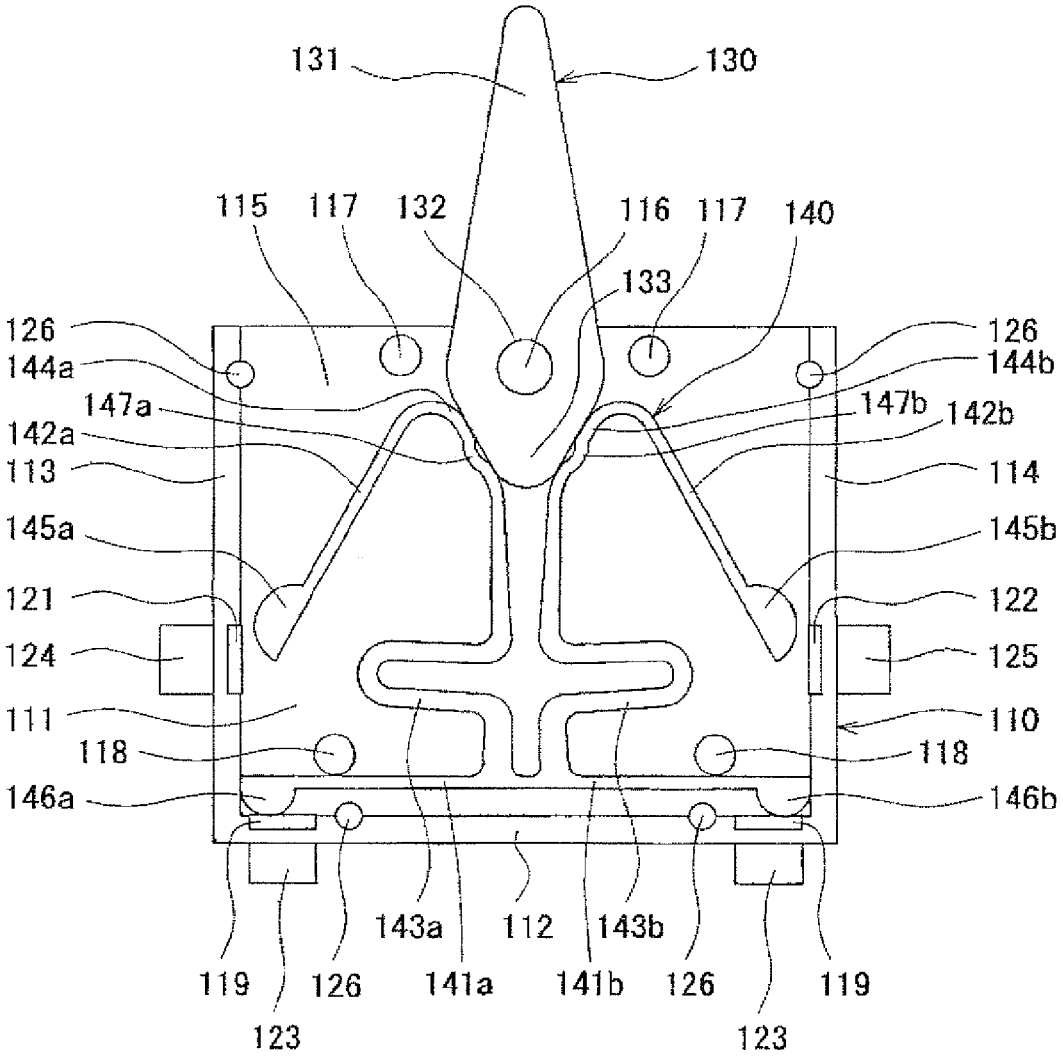
FIG. 14 is a diagram of a switch according to a sixth embodiment of the present invention.

As illustrated in FIG. 14, the base 110, which has a U-shaped peripheral wall defined on the upper face thereof, forms a housing recess (hereinafter, referred to as "recess") 111 which accommodates thereinside the electrically conductive elastic member 140 described below. The peripheral wall includes a lower peripheral portion 112, a left peripheral portion 113, and a right peripheral portion 114, and an upper opening 115.

A shaft 116, which is fitted in a hole 132 of the actuator 130 described below, is arranged at the center of the opening 115. Also, restricting parts 117, 117 are arranged on both sides of the shaft 116 for restricting the rotating range of the actuator 130 about the shaft 116. Positioning parts 118 are arranged on the recess 111 for positioning the fixed contacts 141*a* and 141*b* of the electrically conductive elastic member 140 described below.

Lower fixed contacts 119 are arranged on opposite ends of the inner side surface of the lower peripheral portion 112. The two lower fixed contacts 119 are arranged so that even when unexpected contact occurs in one contact, the other ensures a reliable contact.

A left fixed contact 121 is arranged on the inner side surface of the left peripheral portion 113, while a right fixed contact 122 is arranged on the inner side surface of the right peripheral portion 114. The left fixed contact 121 and the right fixed contact 122 are arranged within the movable ranges of contacts 145*a* and 145*b* of movable contacts 142*a* and 142*b* of the electrically conductive elastic member 140 described below in which they make contacts with the associated fixed contacts.

The fixed contacts 119, 121, and 122 include connecting portions 123, 124, and 125, respectively, which protrude from the outer side surfaces of the peripheral portions 112 to 114.

Snug fitting projections 126 are arranged on the peripheral portions 112 to 114 of the base 110 which fit in the associated fitting holes 151 of the cover 150.

The actuator 130 includes an operating portion 131 arranged on one side of the hole 132 in which the shaft 116 of the base 110 fits and a driving portion 133 arranged on the other side thereof. The operating portion 131 and the driving portion 133 are formed substantially in the form of isosceles triangles. The hole 132 is arranged on the longitudinal center of the actuator 130. The tip of the driving portion 133 is rounded.

The driving portion 133 presses a left driven portion 144*a* of the electrically conductive elastic member 140 described below when the actuator 130 is rotated clockwise from the first position through the operating portion 131 and presses a right driven portion 144*b* of the electrically conductive elastic member 140 described below when the actuator 130 is rotated counterclockwise from the first position.

The electrically conductive elastic member 140, which is manufactured by electroforming, includes the aligned fixed contacts 141*a* and 141*b* and the movable contacts 142*a* and 142*b*, which are arranged symmetrically.

Contacts (fixe contacts) 146*a* and 146*b* are formed at the tips of the fixed contacts 141*a* and 141*b*, respectively, which are arranged to bring into contact with the lower fixed contacts 119.

The movable contacts 142*a* and 142*b* include extendable and compressible portions 143*a* and 143*b* and driven portions 144*a* and 144*b*, respectively, in this order from the fixed contacts 141*a* and 141*b*, respectively. The extendable and compressible portions 143*a* and 143*b* are curved in substantially a U-shaped configuration, and the driven portions 144*a* and 144*b* are extended upward from the tips thereof.

Engagement recesses 147*a* and 147*b* with which the driving portion 133 of the actuator 130 engages at the second and the third positions described below are formed in the driven portions 144*a* and 144*b*, respectively.

The movable contacts 142*a* and 142*b* are curved so as to extend toward the fixed contacts 121 and 122 arranged on the peripheral portions 113 and 114 at the distal end side of the driven portions 144*a* and 144*b*, respectively.

The contacts (movable contacts) 145*a* and 145*b* are formed at the tips of the movable contacts 142*a* and 142*b*, respectively.

The cover 150, which is a plate-like member sized and shaped to cover the base 110, has the fitting holes 151 defined at positions corresponding to the snug fitting projections 126 of the base 110.

The fixed contacts 141*a* and 141*b* of the electrically conductive elastic member 140 are arranged and positioned between the lower peripheral portion 112 and the positioning parts 118 of the base 110, for accommodating the electrically conductive elastic member 140 in the recess 111 of the base 110. In addition, the shaft 116 of the base 110 is fitted in the associated hole 132 of the actuator 130, thereby positioning the operating portion 131 of the actuator 130 at the center of the opening 115 of the base 110 and the actuator 130 in the recess 111. In this condition, the driven portions 144*a* and 144*b* are arranged in a manner that they are forced by the driving portion 133 of the actuator 130. The driven portions 144*a* and 144*b* are in contact with the driving portion 133 so that the driving portion 133 of the actuator 130 in the first position (neutral position) described below and the movable contacts 142*a* and 142*b* do not occur unwanted displacement thereof. Subsequently, the snug fitting projections 126 of the base 110 are snug-fitted in the associated fitting holes 151 of the cover 150, and then the snug fitting projections 126 are fused to connect them integrally.

Next, an operation of the switch so constructed will be described.

First, in the first position (neutral position) illustrated in FIG. 14, the driving portion 133 of the actuator 130 is in contact with the driven portions 144*a* and 144*b* of the movable contacts 142*a* and 142*b* so that no unwanted displacement occurs in the movable contacts 142*a* and 142*b*. In the first position, the contacts 145*a* and 145*b* are out of contact with any of the fixed contacts 121 and 122, and then the switch is disconnected.

When the actuator 130 is rotated clockwise from the first position through the operating portion 131, the driving portion 133 of the actuator 130 presses the driven portion 144*a* of the movable contact 142*a* and the contact 145*a* of the movable contact 142*a* comes into contact with the left fixed contact 121 at the intermediate position between the first position and the second positon described below. At the intermediate position, the left fixed contact 121 and the lower fixed contacts 119 are disconnected.

When the load on the actuator 130 is removed at the intermediate position, the actuator 130 is forced back to the first position through the elastic return force of the movable contact 142*a*.

Figure 15:
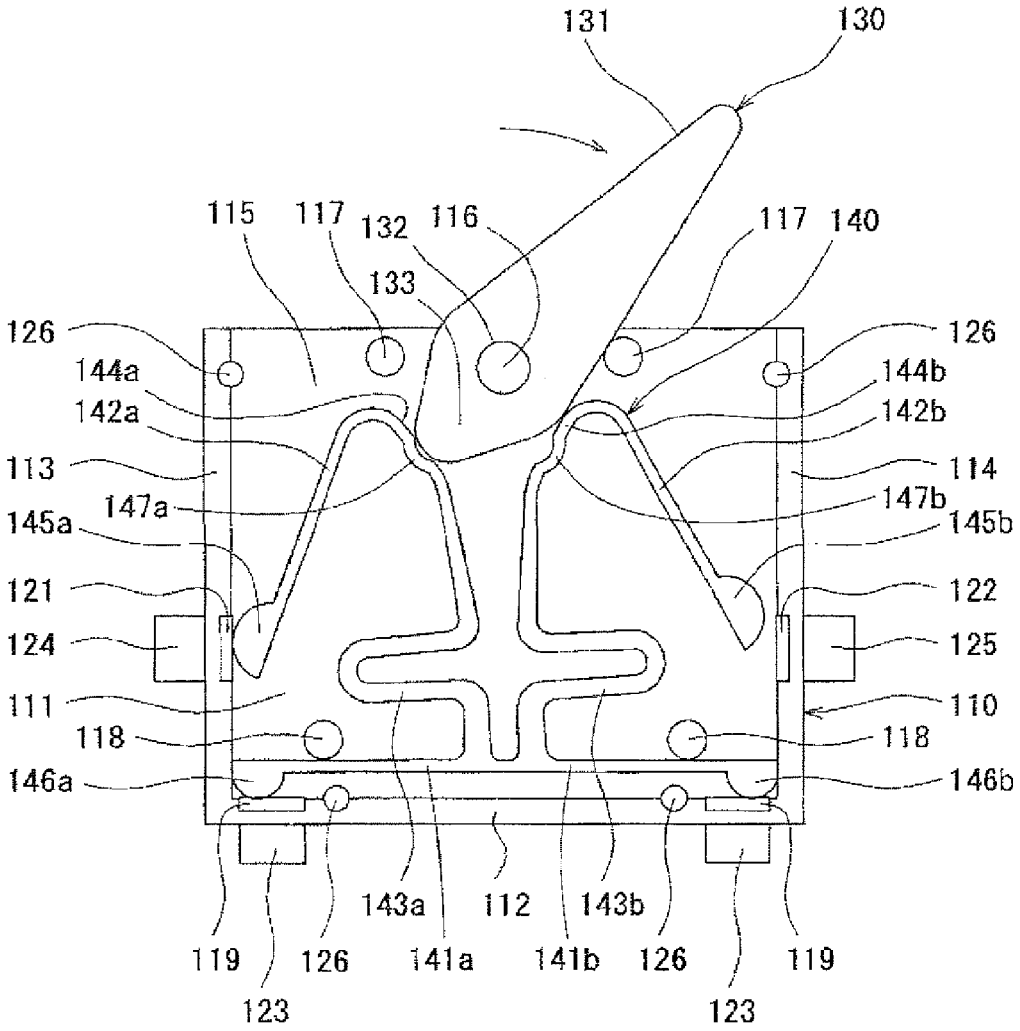
FIG. 15 is a diagram illustrating a position of the switch according to the sixth embodiment of the present invention.

When the actuator 130 is further rotated clockwise from the intermediate position, as illustrated in FIG. 15, the driving portion 133 of the actuator 130 engages the engagement recess 147*a* of the driven portion 144*a* of the electrically conductive elastic member 140, and the actuator 130 reaches the second position. In the second position, the movable contact 142*a* is forced toward the first position. Also in the second position, the contact 145*a* is in contact with the left fixed contact 121, electrically connecting between the left fixed contact 121 and the lower fixed contacts 119, 119.

When the actuator 130 is rotated counterclockwise from the second position through the operating portion 131, the driven portion 144*a* of the electrically conductive elastic member 140 elastically deforms and the driving portion 133 of the actuator 130 moves past the end of the engagement recess 147*a* of the driven portion 144*a*, which allows that the movable contact 142*a* elastically returns due to, to a large extend, the spring force of the extendable and compressible portion 143*a* to the first position. This separates the contact 145*a* from the left fixed contact 121 and also separates the left fixed contact 121 and the lower fixed contacts 119 from each other.

When the actuator 130 is rotated counterclockwise from the first position, the actuator 130 works in a different way. Specifically, in the third position the driving portion 133 of the actuator 130 engages with the engagement recess 147*b* of the driven portion 144*b* of the electrically conductive elastic member 140. Also in the third position and the intermediate position between the first position and the third position, the right fixed contact 122 and the lower fixed contacts 119 are electrically connected to each other.

The similar occurs when the actuator 130 is rotated clockwise from the third position.

According to the sixth embodiment, when the driving portion of the actuator 133 is rotated from the second position or the third position and moved past the ends of the engagement recesses 147*a* and 147*b* of the driven portions 144*a* and 144*b* of the electrically conductive elastic member 140, the actuator 130 is forced back to the first position by the elastic return force of the electrically conductive elastic member 140.

The fixed contacts 141*a* and 141*b* and the movable contacts 142*a* and 142*b* are integrally formed to constitute the electrically conductive elastic member 140, reducing the number of components, manufacturing costs, and assembling processes.

The contact structure and the spring structure are arranged on the same plane, and the thin electrically conductive elastic member 140 is housed in the plate-shaped housing recess 111, thereby achieving the slimming down of the switch. This can reduce switch mounting space and facilitate the slimming down of electronic devices.

Further, the contact and spring structures are arranged on the same plane, and the electrically conductive thin elastic member 140 is fitted in the planar fitting recess 111, which reduces the thickness of the switch. This in turn reduces a space for accommodating the switch and facilitates the thinning of the electronic devices.

Typically, the switch of the sixth embodiment functions as a switch which returns when a hand is released and also functions as a switch which is capable of being held when rotated to the final point and maintaining its operation without any hand intervention when required by an operator.

Figure 16:
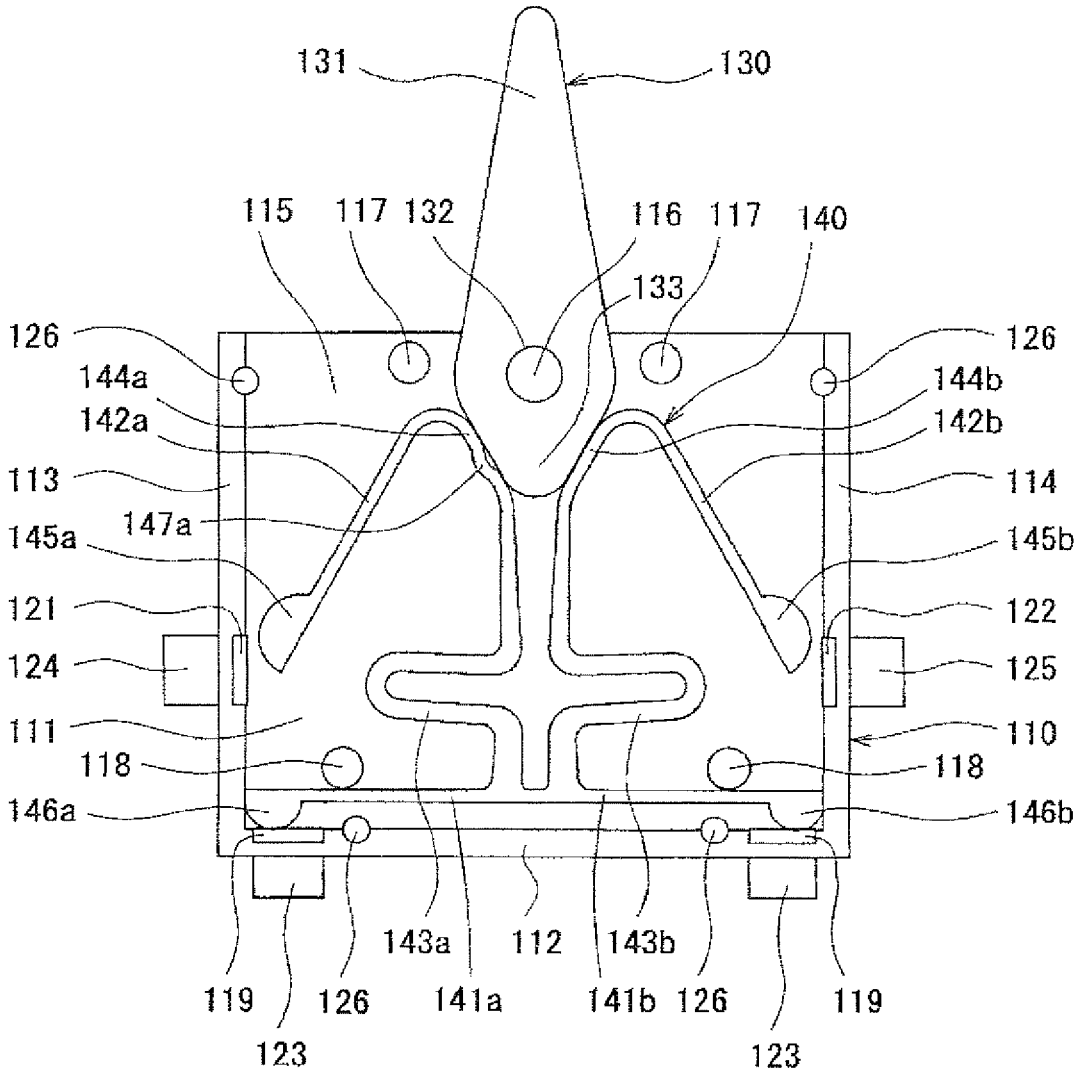
FIG. 16 is a diagram illustrating a modification of the switch according to the sixth embodiment.

As illustrated in FIG. 16, the switch of the first embodiment may be a switch which causes the driving portion 133 of the actuator 130 to engage with the engagement recess 147*a* of the electrically conductive elastic member 140 to be maintained at the second position on one side of the first position without forming any engagement recess in the driven portion 144*b* of the movable contact 142*b* of the electrically conductive elastic member 140 and that automatically returns to the first position when the load applied to the operating portion 131 of the actuator 130 is removed at the third position arranged on the other side of the first position.

Although the above describes the switch having several positions on either side of the first position, a switch may be constituted so that the actuator is moved only in one way from the first position, i.e., so that it includes three fixed terminals and has first and second positions in which the switch takes on-state.

One of the three fixed terminals may be a dummy terminal. In this instance, the switch takes on and off states.

It is understood that the present invention is not limited to the above described embodiments, and may be a switch including other engagement recesses, other engagement convex portions engaging the other engagement recesses, and other elastic portions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

10 base
11 fitting recess
12 shaft
13 engagement convex portion
14 peripheral portion
15 operational opening
16 first fixed contact
17 second fixed contact
18 third fixed contact
19 fourth fixed contact
20 fifth fixed contact
21, 22, 23, 24, 25 connecting portions
26 fitting protrusion
30 actuator
31 elastic frame
32 operating portion
33 fitting portion
34 movable contacting portion
35 first engagement recess
36 second engagement recess
37 third engagement recess
38*a*, 38*b* contact
40 cover
41 fitting hole
50 base
51 housing recess
52 operational opening
53 upper peripheral portion
54 lower peripheral portion
55 left peripheral portion
56 right peripheral portion
57 lower guide
58 central Guide
58*a* engagement convex portion
59 first fixed contact
60 second fixed contact
61 third fixed contact
62 fourth fixed contact
63 fifth fixed contact
64, 65, 66, 67, 68 connecting portions
69 fitting protrusion
70 actuator
71 frame
72 operating portion

72*a* hole
73 elastic engagement portion
74 movable contacting portion
75 first engagement recess
76 narrowing portion
77 second engagement recess
78 narrowing portion
79 third engagement recess
80*a*, 80*b* contact
81 elastic inclined portion
82 first engagement recess
83 second engagement recess
84 third engagement recess
85 common fixed contact
86 engagement convex portion (Elastic portion)
87 tortuous portion
88 overlapped portion
90 cover
91 fitting hole
101 arm
102 leg
103 elastic portion
104 First movable contacting portion
105 Second movable contacting portion
106 engagement convex portion
107*a*, 107*b* contact
108 bellows (elastic portion)
110 base
111 housing recess
112 lower peripheral portion
113 left peripheral portion
114 right peripheral portion
115 opening
116 shaft
117 restricting part
118 positioning part
119 lower fixed contact
121 left fixed contact
122 right fixed contact
123 connecting portions
124 connecting portions
125 connecting portions
126 crimping protrusion
130 actuator
131 operating portion
132 hole
133 driving portion (Engagement convex portion)
140 electrically conductive elastic member
141*a*, 141*b* fixed contact
142*a*, 142*b* movable contact
143*a*, 143*b* extendable and compressible portion
144*a*, 144*b* driven portion
145*a*, 145*b* contact (Movable contact)
146*a*, 146*b* contact (Fixed contact)
147*a*, 147*b* engagement recess
150 cover
151 fitting hole

The invention claimed is:

1. A switch, comprising:

a base comprising:

a recess, and a plurality of fixed contacts mounted in an inner side face of the recess;

an electrically conductive actuator disposed within the recess of the base, the electrically conductive actuator having a pair of movable contact portions and an elastically deformable elastic portion, the movable contact portions having movable contacts capable of being connected to respective fixed contacts;

at least one engagement convex portion disposed on one of the base and the electrically conductive actuator; and at least one engagement concave portion disposed on the other of the base and the electrically conductive actuator and engageable with the at least one engagement convex portion, wherein the elastic portion of the electrically conductive actuator is elastically deformed to break an engagement between the engagement convex and concave portions when the actuator moves between a first position and a second position, and wherein in the first position, the fixed and movable contacts are in contact with each other, and the engagement convex and concave portions are engaged with each other.

2. The switch according to claim 1, wherein the upper surface of the electrically conductive actuator is flush with the upper surface of the base.

3. The switch according to claim 1, wherein the actuator takes a third position which is adjacent the first position but away from the second position, wherein in the third position the fixed and movable contacts are in contact with each other and the engagement convex and concave portions are engaged with each other so that the engagement thereof is self-maintained.

4. The switch according to claim 1, wherein the actuator takes a third position which is adjacent the first position but away from the second position, wherein in the third position the elastic portion is compressed, causing the electrically conductive actuator to move back into the first position.

5. The switch according to claim 1, wherein the electrically conductive actuator is of a rotating type.

6. The switch according to claim 5, wherein the elastic portion is a circular frame having the at least one engagement recess.

7. The switch according to claim 1, wherein the electrically conductive actuator is of a sliding type.

8. The switch according to claim 7, wherein the electrically conductive actuator comprises a substantially rectangular frame, wherein the at least one engagement recess is disposed on the elastic portion, and wherein the elastic portion connects two facing sides of the frame.

9. The switch according to claim 1, wherein the electrically conductive actuator comprises an operating portion, wherein the operating portion, the movable contacts, and the elastic portion are separately manufactured by electroforming and are arranged on the same plane, and wherein the operating portion, the movable contacts, and the elastic portion are integrated with each other.

10. The switch according to claim 1, wherein the electrically conductive actuator comprises an operating portion, wherein the operating portion, the movable contacts, and the elastic portion are separately manufactured by electroforming and are arranged on the same plane, and wherein the operating portion, the movable contacts, and the elastic portion are separated from each other.

11. The switch according to claim 2, wherein the actuator takes a third position which is adjacent the first position but away from the second position, wherein in the third position the fixed and movable contacts are in contact with each other and the engagement convex and concave portions are engaged with each other so that the engagement thereof is self-maintained.

12. The switch according to claim 2, wherein the actuator takes a third position which is adjacent the first position but away from the second position, wherein in the third position the elastic portion is compressed, causing the electrically conductive actuator to move back into the first position.

13. The switch according to claim 2, wherein the electrically conductive actuator is of a rotating type.

14. The switch according to claim 3, wherein the electrically conductive actuator is of a rotating type.

15. The switch according to claim 2, wherein the electrically conductive actuator is of a sliding type.

16. The switch according to claim 3, wherein the electrically conductive actuator is of a sliding type.

17. The switch according to claim 4, wherein the electrically conductive actuator is of a sliding type.

18. The switch according to claim 2, wherein the electrically conductive actuator comprises an operating portion, wherein the operating portion, the movable contacts, and the elastic portion are separately manufactured by electroforming and are arranged on the same plane, and wherein the operating portion, the movable contacts, and the elastic portion are integrated with each other.

19. The switch according to claim 3, wherein the electrically conductive actuator comprises an operating portion, wherein the operating portion, the movable contacts, and the elastic portion are separately manufactured by electroforming and are arranged on the same plane, and wherein the operating portion, the movable contacts, and the elastic portion are integrated with each other.

20. The switch according to claim 4, wherein the electrically conductive actuator comprises an operating portion, wherein the operating portion, the movable contacts, and the elastic portion are separately manufactured by electroforming and are arranged on the same plane, and wherein the operating portion, the movable contacts, and the elastic portion are integrated with each other.

* * * * *